US011502417B2

(12) United States Patent
Yoon et al.

(10) Patent No.: US 11,502,417 B2
(45) Date of Patent: Nov. 15, 2022

(54) WAVEGUIDE ANTENNA ELEMENT BASED BEAM FORMING PHASED ARRAY ANTENNA SYSTEM FOR MILLIMETER WAVE COMMUNICATION

(71) Applicant: Movandi Corporation, Irvine, CA (US)

(72) Inventors: Seunghwan Yoon, Irvine, CA (US); Ahmadreza Rofougaran, Newport Beach, CA (US); Sam Gharavi, Irvine, CA (US); Kartik Sridharan, San Diego, CA (US); Donghyup Shin, Irvine, CA (US); Farid Shirinfar, Granada Hills, CA (US); Stephen Wu, Fountain Valley, CA (US); Maryam Rofougaran, Rancho Palos Verdes, CA (US); Alfred Grau Besoli, Irvine, CA (US); Enver Adas, Newport Beach, CA (US)

(73) Assignee: MOVANDI CORPORATION, Irvine, CA (US)

( * ) Notice: Subject to any disclaimer, the term of this patent is extended or adjusted under 35 U.S.C. 154(b) by 0 days.

(21) Appl. No.: 17/329,276

(22) Filed: May 25, 2021

(65) Prior Publication Data

US 2021/0336347 A1 Oct. 28, 2021

Related U.S. Application Data

(63) Continuation of application No. 16/354,390, filed on Mar. 15, 2019, now Pat. No. 11,088,457, which is a (Continued)

(51) Int. Cl.
*H01Q 1/24* (2006.01)
*H01Q 13/02* (2006.01)
(Continued)

(52) U.S. Cl.
CPC ..... *H01Q 13/0233* (2013.01); *H01Q 1/2283* (2013.01); *H01Q 13/06* (2013.01);
(Continued)

(58) Field of Classification Search
CPC ..... H01Q 13/0233; H01Q 13/2283; H01Q 21/0025; H01Q 21/245
(Continued)

(56) References Cited

U.S. PATENT DOCUMENTS 6,731,904 B1 5/2004 Judd
7,079,079 B2 7/2006 Jo et al.
(Continued)

OTHER PUBLICATIONS

Corrected Notice of Allowance for U.S. Appl. No. 16/125,757 dated Jul. 16, 2021.
(Continued)

*Primary Examiner* — Binh B Tran
(74) *Attorney, Agent, or Firm* — Chip Law Group

(57) ABSTRACT

An antenna system includes a first substrate, a plurality of chips and a waveguide antenna element based beam forming phased array that includes a plurality of radiating waveguide antenna cells for millimeter wave communication. Each radiating waveguide antenna cell includes a plurality of pins where a first pin is connected with a body of a corresponding radiating waveguide antenna cell and the body corresponds to ground for the pins. The first pin includes a first and a second current path, the first current path being longer than the second current path. A first end of the radiating waveguide antenna cells is mounted on the first substrate, where the plurality of chips are electrically connected with the plurality of pins and the ground of each of the plurality of radiating waveguide antenna cells.

20 Claims, 27 Drawing Sheets

Related U.S. Application Data continuation-in-part of application No. 15/904,521, filed on Feb. 26, 2018, now Pat. No. 10,637,159.

(51) Int. Cl.

| | |
|---|---|
| ***H01Q 21/00*** | (2006.01) |
| ***H01Q 13/06*** | (2006.01) |
| ***H01Q 21/24*** | (2006.01) |
| ***H01Q 1/22*** | (2006.01) |
| ***H01Q 21/06*** | (2006.01) |

(52) U.S. Cl.
CPC ..... *H01Q 21/0025* (2013.01); *H01Q 21/064* (2013.01); *H01Q 21/245* (2013.01)

(58) Field of Classification Search
USPC ..... 343/702
See application file for complete search history.

(56) References Cited

U.S. PATENT DOCUMENTS

| | | | | |
|---|---|---|---|---|
| 7,675,465 | B2 | 3/2010 | Doan et al. | |
| 7,715,466 | B1 | 5/2010 | Oh et al. | |
| 9,130,262 | B2 | 9/2015 | Park et al. | |
| 9,178,546 | B1 | 11/2015 | Klemes | |
| 10,103,853 | B2 | 10/2018 | Moshfeghi | |
| 10,320,090 | B2 | 6/2019 | Zou et al. | |
| 10,560,179 | B2 | 2/2020 | Gharavi et al. | |
| 10,854,995 | B2 | 12/2020 | Rofougaran et al. | |
| 11,075,724 | B2 | 7/2021 | Moshfeghi | |
| 11,088,756 | B2 | 8/2021 | Gharavi et al. | |
| 2004/0204114 | A1 | 10/2004 | Brennan et al. | |
| 2005/0088260 | A1 | 4/2005 | Ajioka et al. | |
| 2005/0136943 | A1 | 6/2005 | Banerjee et al. | |
| 2006/0170595 | A1 | 8/2006 | Gustaf | |
| 2009/0066590 | A1* | 3/2009 | Yamada | H01Q 19/062 343/702 |
| 2009/0175214 | A1 | 7/2009 | Sfar et al. | |
| 2010/0167639 | A1 | 7/2010 | Ranson et al. | |
| 2010/0284446 | A1 | 11/2010 | Mu et al. | |
| 2011/0190005 | A1 | 8/2011 | Cheon et al. | |
| 2011/0294415 | A1 | 12/2011 | Jeon et al. | |
| 2012/0003925 | A1 | 1/2012 | Coldrey et al. | |
| 2013/0003645 | A1 | 1/2013 | Shapira et al. | |
| 2013/0039342 | A1 | 2/2013 | Kazmi | |
| 2013/0149300 | A1 | 6/2013 | Hiatt et al. | |
| 2015/0296344 | A1 | 10/2015 | Trojer et al. | |
| 2016/0049723 | A1 | 2/2016 | Baks et al. | |
| 2016/0056946 | A1 | 2/2016 | Moher | |
| 2016/0204513 | A1 | 7/2016 | Yemelong et al. | |
| 2018/0063139 | A1 | 3/2018 | Day et al. | |
| 2019/0020402 | A1 | 1/2019 | Gharavi et al. | |
| 2019/0089069 | A1* | 3/2019 | Niroo | H01Q 1/2291 |
| 2019/0139914 | A1* | 5/2019 | Kirino | G01S 13/34 |
| 2019/0297648 | A1 | 9/2019 | Nagaraja et al. | |
| 2020/0036414 | A1 | 1/2020 | Shattil | |
| 2020/0185299 | A1 | 6/2020 | Chang et al. | |
| 2020/0322016 | A1 | 10/2020 | Kim et al. | |
| 2021/0109145 | A1 | 4/2021 | Haustein et al. | |

OTHER PUBLICATIONS

Corrected Notice of Allowance for U.S. Appl. No. 16/125,757 dated Jun. 28, 2021.
Corrected Notice of Allowance for U.S. Appl. No. 16/204,397 dated Jun. 7, 2021.
Corrected Notice of Allowance for U.S. Appl. No. 16/233,044 dated Jun. 11, 2021.
Corrected Notice of Allowance for U.S. Appl. No. 16/354,390 dated Jul. 13, 2021.
Corrected Notice of Allowance for U.S. Appl. No. 16/354,390 dated Jun. 3, 2021.
Corrected Notice of Allowance for U.S. Appl. No. 16/364,956 dated Jun. 23, 2021.
Corrected Notice of Allowance for U.S. Appl. No. 16/377,847 dated Aug. 20, 2021.
Corrected Notice of Allowance for U.S. Appl. No. 16/377,847 dated Jul. 13, 2021.
Corrected Notice of Allowance for U.S. Appl. No. 16/377,847 dated Jul. 6, 2021.
Corrected Notice of Allowance for U.S. Appl. No. 16/388,043 dated Aug. 27, 2021.
Corrected Notice of Allowance for U.S. Appl. No. 16/391,628 dated Jul. 30, 2021.
Corrected Notice of Allowance for U.S. Appl. No. 16/391,628 dated Jun. 29, 2021.
Corrected Notice of Allowance for U.S. Appl. No. 16/398,156 dated Aug. 13, 2021.
Corrected Notice of Allowance for U.S. Appl. No. 16/689,758 dated Jul. 6, 2021.
Corrected Notice of Allowance for U.S. Appl. No. 16/689,758 dated May 27, 2021.
Final Office Action for U.S. Appl. No. 17/011,042 dated Jul. 2, 2021.
Non-Final Office Action for U.S. Appl. No. 17/091,520 dated Jul. 8, 2021.
Notice of Allowability for U.S. Appl. No. 16/819,388 dated May 27, 2021.
Notice of Allowance for U.S. Appl. No. 16/233,044 dated Jun. 4, 2021.
Notice of Allowance for U.S. Appl. No. 16/398,156 dated Jul. 6, 2021.
Supplemental Notice of Allowance for U.S. Appl. No. 16/451,980 dated Aug. 6, 2021.
Supplemental Notice of Allowance for U.S. Appl. No. 16/451,980 dated Jun. 30, 2021.
Supplemental Notice of Allowance for U.S. Appl. No. 16/451,998 dated Jun. 24, 2021.
Supplemental Notice of Allowance for U.S. Appl. No. 16/666,680 dated Jul. 9, 2021.
Supplemental Notice of Allowance for U.S. Appl. No. 16/666,680 dated Jun. 10, 2021.
Supplemental Notice of Allowance for U.S. Appl. No. 16/866,536 dated Jul. 21, 2021.
Supplemental Notice of Allowance for U.S. Appl. No. 16/866,536 dated Jun. 7, 2021.
Supplemental Notice of Allowance for U.S. Appl. No. 16/941,690 dated Aug. 9, 2021.
Corrected Notice of Allowance for U.S. Appl. No. 16/920,191 dated Feb. 15, 2022.
Corrected Notice of Allowance for U.S. Appl. No. 17/091,520 dated Dec. 14, 2021.
Corrected Notice of Allowance for U.S. Appl. No. 17/091,520 dated Feb. 2, 2022.
Corrected Notice of Allowance for U.S. Appl. No. 17/091,520 dated Jan. 28, 2022.
Final Office Action for U.S. Appl. No. 17/011,042 dated Mar. 14, 2022.
Non-Final Office Action for U.S. Appl. No. 16/927,225 dated Dec. 22, 2021.
Non-Final Office Action for U.S. Appl. No. 16/935,422 dated Jan. 21, 2022.
Non-Final Office Action for U.S. Appl. No. 16/935,515 dated Jan. 21, 2022.
Non-Final Office Action for U.S. Appl. No. 17/004,373 dated Feb. 15, 2022.
Non-Final Office Action for U.S. Appl. No. 17/060,182 dated Feb. 25, 2022.
Non-Final Office Action for U.S. Appl. No. 17/337,529 dated Jan. 26, 2022.
Notice of Allowance for U.S. Appl. No. 16/920,191 dated Feb. 2, 2022.
Corrected Notice of Allowance for U.S. Appl. No. 16/233,044 dated Sep. 10, 2021.

(56) References Cited

OTHER PUBLICATIONS

Corrected Notice of Allowance for U.S. Appl. No. 16/398,156 dated Nov. 17, 2021.
Non-Final Office Action for U.S. Appl. No. 16/920,191 dated Oct. 15, 2021.
Non-Final Office Action for U.S. Appl. No. 17/011,042 dated Oct. 29, 2021.
Notice of Allowance for U.S. Appl. No. 17/091,520 dated Oct. 27, 2021.
Corrected Notice of Allowance for U.S. Appl. No. 16/920,191 dated May 10, 2022.
Corrected Notice of Allowance for U.S. Appl. No. 16/920,191 dated May 18, 2022.
Corrected Notice of Allowance for U.S. Appl. No. 16/935,422 dated Jun. 8, 2022.
Corrected Notice of Allowance for U.S. Appl. No. 16/935,515 dated Jun. 8, 2022.
Corrected Notice of Allowance for U.S. Appl. No. 17/091,520 dated Apr. 26, 2022.
Corrected Notice of Allowance for U.S. Appl. No. 17/091,520 dated Mar. 17, 2022.
Non-Final Office Action for U.S. Appl. No. 17/208,984 dated Apr. 12, 2022.
Non-Final Office Action for U.S. Appl. No. 17/230,566 dated Apr. 12, 2022.
Non-Final Office Action for U.S. Appl. No. 17/243,747 dated Jun. 6, 2022.
Notice of Allowance for U.S. Appl. No. 16/935,515 dated Jun. 1, 2022.
Notice of Allowance for U.S. Appl. No. 17/004,373 dated May 23, 2022.
Notice of Allowance for U.S. Appl. No. 16/935,422 dated May 31, 2022.
Notice of Allowance for U.S. Appl. No. 17/060,182 dated Jun. 8, 2022.
Notice of Allowance for U.S. Appl. No. 17/171,521 dated Apr. 6, 2022.
Notice of Allowance for U.S. Appl. No. 17/337,529 dated May 4, 2022.
Corrected Notice of Allowance for U.S. Appl. No. 16/920,191 dated Jun. 22, 2022.
Corrected Notice of Allowance for U.S. Appl. No. 16/935,422 dated Sep. 14, 2022.
Corrected Notice of Allowance for U.S. Appl. No. 16/935,515 dated Sep. 14, 2022.
Corrected Notice of Allowance for U.S. Appl. No. 17/171,521 dated Aug. 29, 2022.
Corrected Notice of Allowance for U.S. Appl. No. 17/171,521 dated Jul. 7, 2022.
Corrected Notice of Allowance for U.S. Appl. No. 17/171,521 dated Jul. 13, 2022.
Corrected Notice of Allowance for U.S. Appl. No. 17/337,529 dated Aug. 3, 2022.
Final Office Action for U.S. Appl. No. 16/927,225 dated Jun. 24, 2022.
Non-Final Office Action for U.S. Appl. No. 17/011,042 dated Jul. 1, 2022.
Non-Final Office Action for U.S. Appl. No. 17/408,606 dated Aug. 16, 2022.
Notice of Allowability for U.S. Appl. No. 17/337,529 dated Aug. 10, 2022.
Notice of Allowability for U.S. Appl. No. 17/004,373 dated Aug. 17, 2022.
Notice of Allowability for U.S. Appl. No. 17/004,373 dated Aug. 31, 2022.
Notice of Allowability for U.S. Appl. No. 17/060,182 dated Aug. 19, 2022.
Notice of Allowability for U.S. Appl. No. 17/060,182 dated Sep. 20, 2022.
Notice of Allowance for U.S. Appl. No. 17/208,984 dated Aug. 16, 2022.
Notice of Allowance for U.S. Appl. No. 17/230,566 dated Aug. 25, 2022.
Notice of Allowance for U.S. Appl. No. 17/365,037 dated Aug. 10, 2022.
Notice of Allowance for U.S. Appl. No. 17/243,747 dated Sep. 27, 2022.

* cited by examiner

WAVEGUIDE ANTENNA ELEMENT BASED BEAM FORMING PHASED ARRAY ANTENNA SYSTEM FOR MILLIMETER WAVE COMMUNICATION

CROSS-REFERENCE TO RELATED APPLICATIONS

This patent application makes reference to, claims priority to, claims the benefit of, and is a Continuation Application of U.S. patent application Ser. No. 16/354,390, filed Mar. 15, 2019, which is a continuation-in-part of U.S. Pat. No. 10,637,159, filed on Feb. 26, 2018.

This application makes reference to:

U.S. Pat. No. 10,321,332, which was filed on May 30, 2017; and

U.S. Pat. No. 10,348,371, which was filed on Dec. 7, 2017.

Each of the above referenced application is hereby incorporated herein by reference in its entirety.

FIELD OF TECHNOLOGY

Certain embodiments of the disclosure relate to an antenna system for millimeter wave-based wireless communication. More specifically, certain embodiments of the disclosure relate to a waveguide antenna element based beam forming phased array antenna system for millimeter wave communication.

BACKGROUND

Wireless telecommunication in modern times has witnessed advent of various signal transmission techniques, systems, and methods, such as use of beam forming and beam steering techniques, for enhancing capacity of radio channels. For the advanced high-performance fifth generation communication networks, such as millimeter wave communication, there is a demand for innovative hardware systems, and technologies to support millimeter wave communication in effective and efficient manner. Current antenna systems or antenna arrays, such as phased array antenna or TEM antenna, that are capable of supporting millimeter wave communication comprise multiple radiating antenna elements spaced in a grid pattern on a flat or curved surface of communication elements, such as transmitters and receivers. Such antenna arrays may produce a beam of radio waves that may be electronically steered to desired directions, without physical movement of the antennas. A beam may be formed by adjusting time delay and/or shifting the phase of a signal emitted from each radiating antenna element, so as to steer the beam in the desired direction. Although some of the existing antenna arrays exhibit low loss, however, mass production of such antenna arrays that comprise multiple antenna elements may be difficult and pose certain practical and technical challenges. For example, the multiple antenna elements (usually more than hundred) in an antenna array, needs to be soldered on a substrate during fabrication, which may be difficult and a time-consuming process. This adversely impacts the total cycle time to produce an antenna array. Further, assembly and packaging of such large sized antenna arrays may be difficult and cost intensive task. Thus, an advanced antenna system may be desirable that may be cost-effective, easy to fabricate, assemble, and capable of millimeter wave communication in effective and efficient manner.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY OF THE DISCLOSURE

A waveguide antenna element based beam forming phased array antenna system for millimeter wave communication, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION OF THE DISCLOSURE

Certain embodiments of the disclosure may be found in a waveguide antenna element based beam forming phased array antenna system for millimeter wave communication. In the following description, reference is made to the accompanying drawings, which form a part hereof, and in which is shown, by way of illustration, various embodiments of the present disclosure.

Figure 1A:
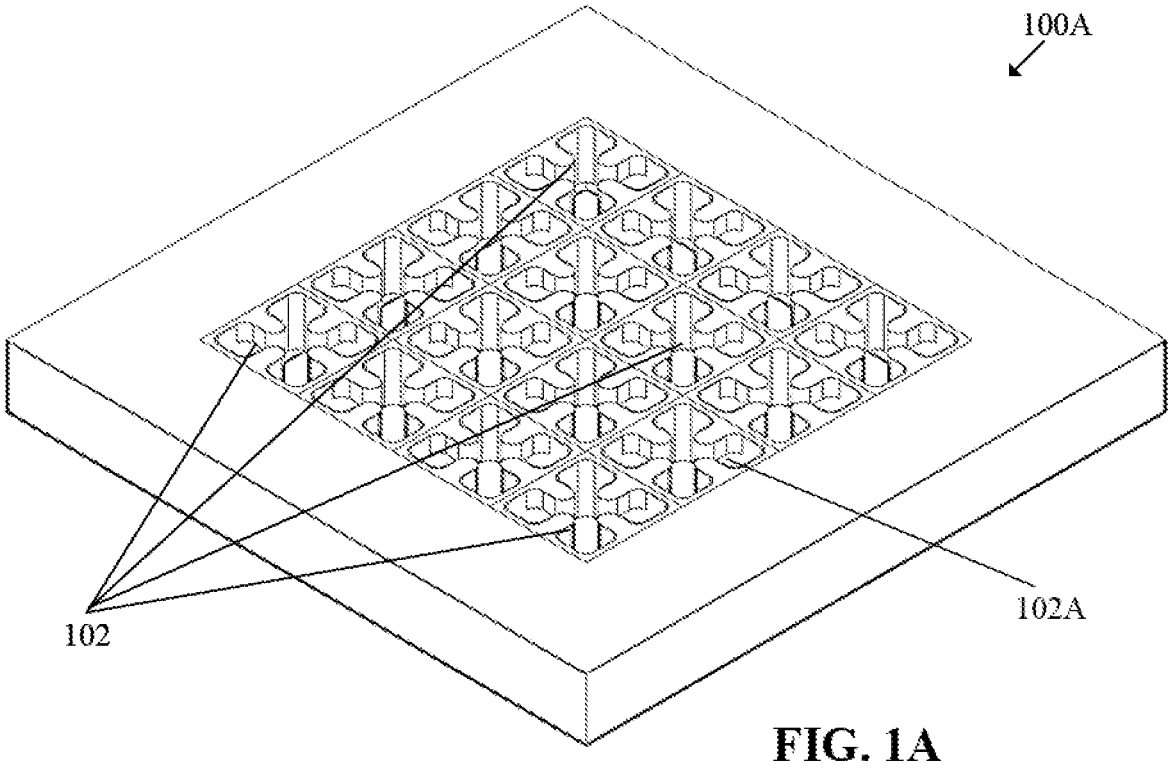
FIG. 1A depicts a perspective top view of an exemplary waveguide antenna element based beam forming phased array antenna system for millimeter wave communication, in accordance with an exemplary embodiment of the disclosure.

FIG. 1A depicts a perspective top view of an exemplary waveguide antenna element based beam forming phased array antenna system for millimeter wave communication, in accordance with an exemplary embodiment of the disclosure. With reference to FIG. 1A, there is shown a waveguide antenna element based beam forming phased array 100A. The waveguide antenna element based beam forming phased array 100A may have a unitary body that comprises a plurality of radiating waveguide antenna cells 102 arranged in a certain layout for millimeter wave communication. The unitary body refers to one-piece structure of the waveguide antenna element based beam forming phased array 100A, where multiple antenna elements, such as the plurality of radiating waveguide antenna cells 102 may be fabricated as a single piece structure, for example, by metal processing or injection molding. In FIG. 1A, an example of four-by-four waveguide array comprising sixteen radiating waveguide antenna cells, such as a radiating waveguide antenna cell 102A, in a first layout, is shown. In some embodiments, the waveguide antenna element based beam forming phased array 100A may be one-piece structure of eight-by-eight waveguide array comprising sixty four radiating waveguide antenna cells in the first layout. It is to be understood by one of ordinary skill in the art that the number of radiating waveguide antenna cells may vary, without departure from the scope of the present disclosure. For example, the waveguide antenna element based beam forming phased array 100A may be one-piece structure of N-by-N waveguide array comprising "M" number of radiating waveguide antenna cells arranged in certain layout, wherein "N" is a positive integer and "M" is N to the power of 2.

In some embodiments, the waveguide antenna element based beam forming phased array 100A may be made of electrically conductive material, such as metal. For example, the waveguide antenna element based beam forming phased array 100A may be made of copper, aluminum, or metallic alloy that are considered good electrical conductors. In some embodiments, the waveguide antenna element based beam forming phased array 100A may be made of plastic and coated with electrically conductive material, such as metal, for mass production. The exposed or outer surface of the waveguide antenna element based beam forming phased array 100A may be coated with electrically conductive material, such as metal, whereas the inner body may be plastic or other inexpensive polymeric substance. The waveguide antenna element based beam forming phased array 100A may be surface coated with copper, aluminum, silver, and the like. Thus, the waveguide antenna element based beam forming phased array 100A may be cost-effective and capable of mass production as a result of the unitary body structure of the waveguide antenna element based beam forming phased array 100A. In some embodiments, the waveguide antenna element based beam forming phased array 100A may be made of optical fiber for enhanced conduction in the millimeter wave frequency.

Figure 1B:
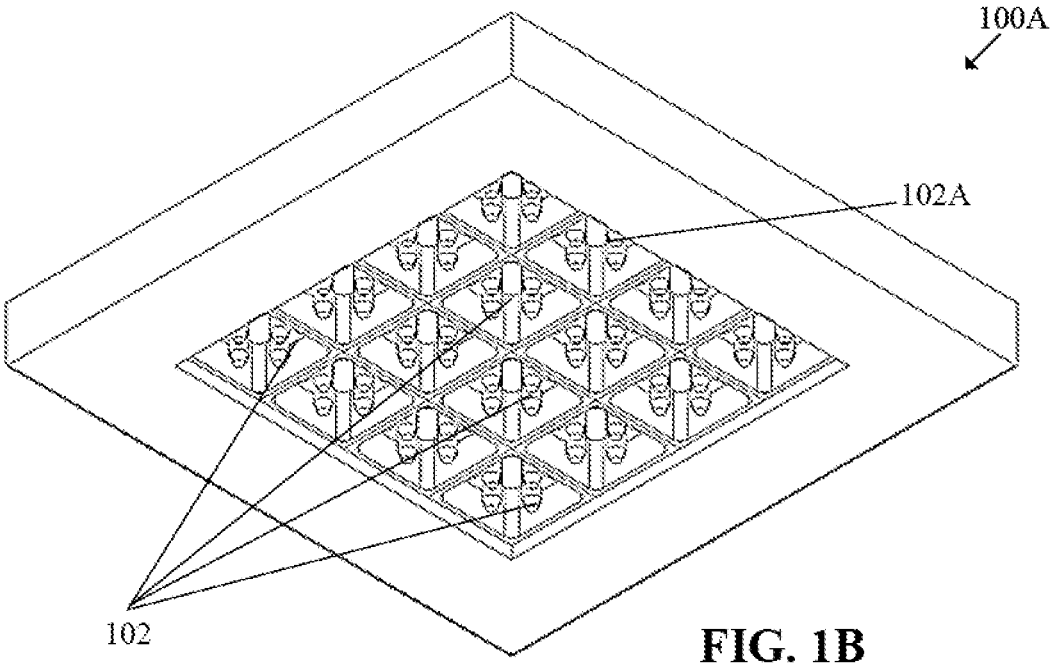
FIG. 1B depicts a perspective bottom view of the exemplary waveguide antenna element based beam forming phased array antenna system of FIG. 1A, in accordance with an exemplary embodiment of the disclosure.

FIG. 1B depicts a perspective bottom view of the exemplary waveguide antenna element based beam forming phased array antenna system of FIG. 1A, in accordance with an exemplary embodiment of the disclosure. With reference to FIG. 1B, there is shown a bottom view of the waveguide antenna element based beam forming phased array 100A that depicts a plurality of pins (e.g. four pins in this case) in each radiating waveguide antenna cell (such as the radiating waveguide antenna cell 102A) of the plurality of radiating waveguide antenna cells 102. The plurality of pins of each corresponding radiating waveguide antenna cell are connected with a body of a corresponding radiating waveguide antenna cell that acts as ground for the plurality of pins. In other words, the plurality of pins of each corresponding radiating waveguide antenna are connected with each other by the ground resulting in the unitary body structure.

Figure 2A:
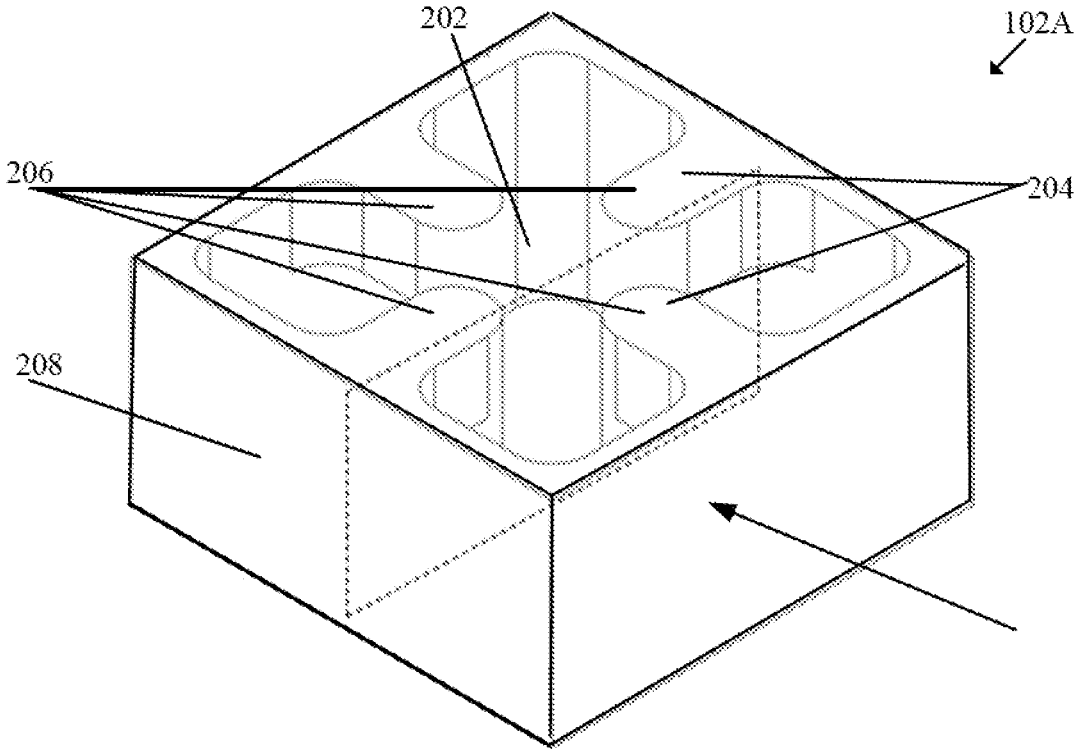
FIG. 2A depicts a perspective top view of an exemplary radiating waveguide antenna cell of the exemplary waveguide antenna element based beam forming phased array antenna system of FIG. 1A, in accordance with an exemplary embodiment of the disclosure.

FIG. 2A depicts a perspective top view of an exemplary radiating waveguide antenna cell of the exemplary waveguide antenna element based beam forming phased array antenna system of FIG. 1A, in accordance with an exemplary embodiment of the disclosure. With reference to FIG. 2A, there is shown a perspective top view of an exemplary single radiating waveguide antenna cell, such as the radiating waveguide antenna cell 102A of FIG. 1A. There is shown an open end 202 of the radiating waveguide antenna cell 102A. There is also shown an upper end 204 of a plurality of pins 206 that are connected with a body of the radiating waveguide antenna cell 102A. The body of the radiating waveguide antenna cell 102A acts as ground 208.

Figure 2B:
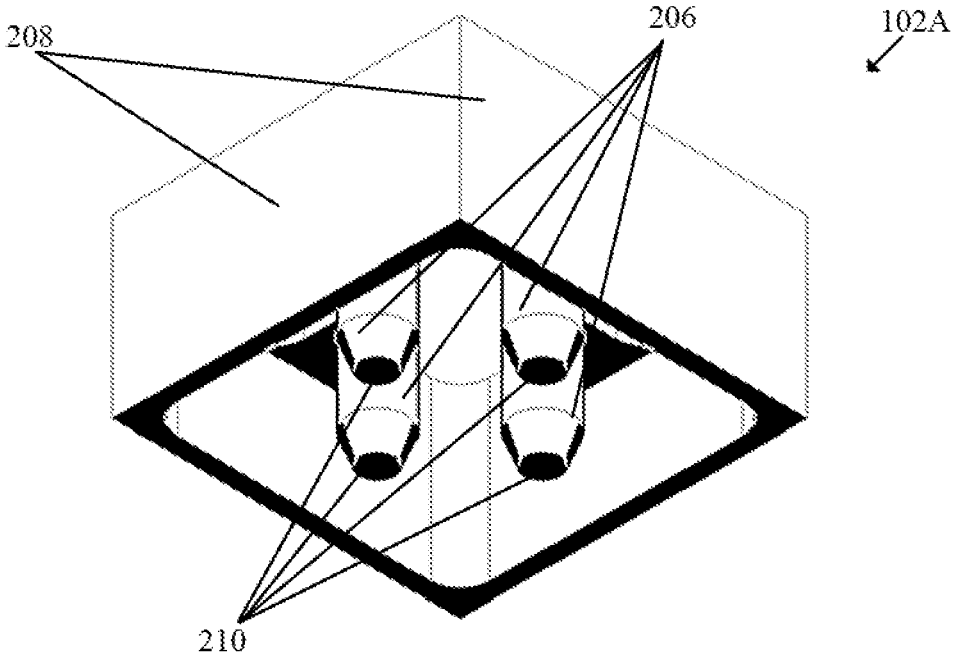
FIG. 2B depicts a perspective bottom view of the exemplary radiating waveguide antenna cell of FIG. 2A, in accordance with an exemplary embodiment of the disclosure.

FIG. 2B depicts a perspective bottom view of the exemplary radiating waveguide antenna cell of FIG. 2A, in accordance with an exemplary embodiment of the disclosure. With reference to FIG. 2B, there is shown a bottom view of the radiating waveguide antenna cell 102A of FIG. 2A. There is shown a first end 210 of the radiating waveguide antenna cell 102A, which depicts a lower end 212 of the plurality of pins 206 that are connected with the body (i.e., ground 208) of the radiating waveguide antenna cell 102A. The plurality of pins 206 may be protrude pins that protrude from the first end 210 from a level of the body of the radiating waveguide antenna cell 102A to establish a firm contact with a substrate on which the plurality of radiating waveguide antenna cells 102 (that includes the radiating waveguide antenna cell 102A) may be mounted.

Figure 3A:
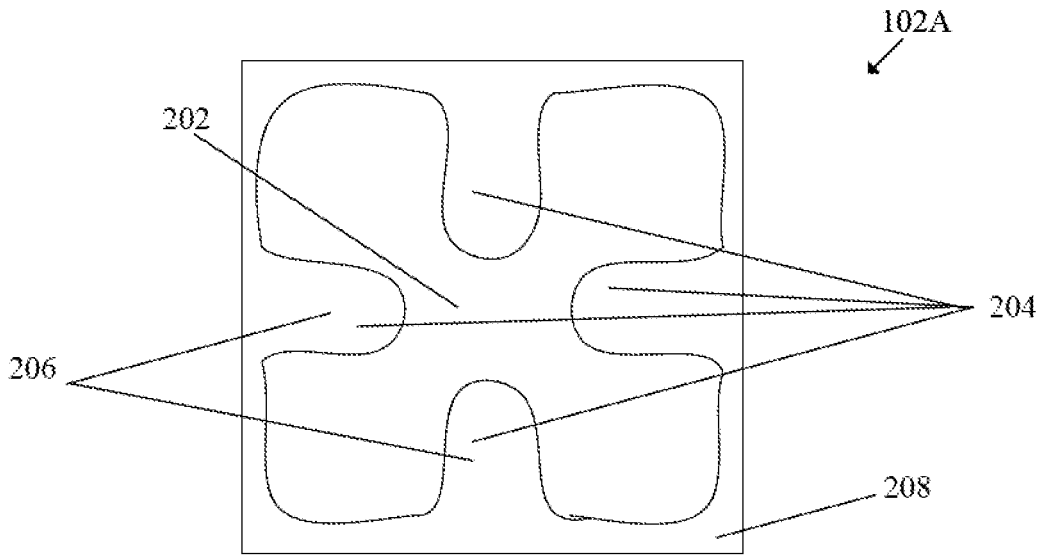
FIG. 3A depicts a schematic top view of an exemplary radiating waveguide antenna cell of the exemplary waveguide antenna element based beam forming phased array antenna system of FIG. 1A, in accordance with an exemplary embodiment of the disclosure.

FIG. 3A depicts a schematic top view of an exemplary radiating waveguide antenna cell of the exemplary waveguide antenna element based beam forming phased array antenna system of FIG. 1A, in accordance with an exemplary embodiment of the disclosure. With reference to FIG. 3A, there is shown the open end 202 of the radiating waveguide antenna cell 102A, the upper end 204 of the plurality of pins 206 that are connected with the body (i.e., ground 208) of the radiating waveguide antenna cell 102A. The body of the radiating waveguide antenna cell 102A acts as the ground 208. The open end 202 of the radiating waveguide antenna cell 102A represents a flat four-leaf like hollow structure surrounded by the ground 208.

Figure 3B:
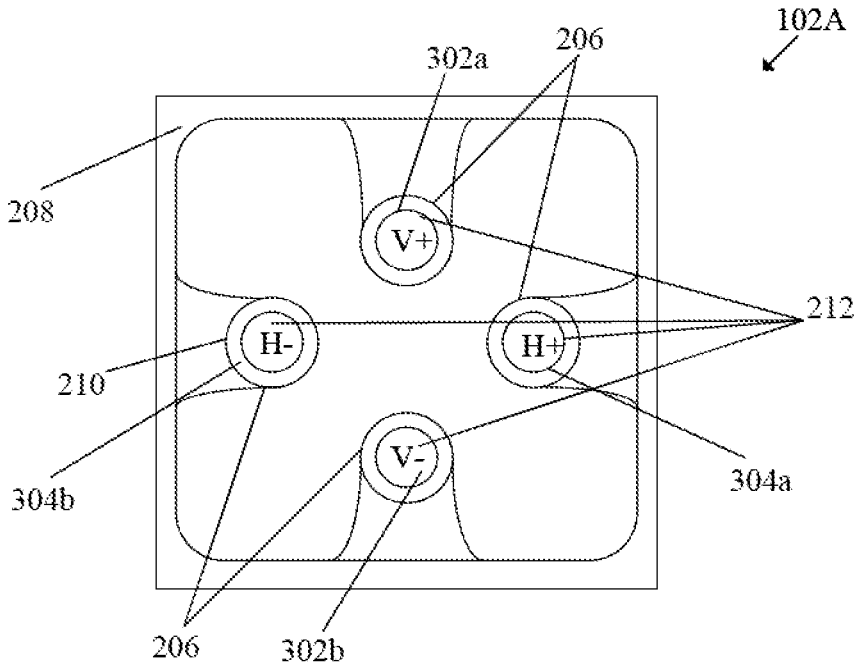
FIG. 3B depicts a schematic bottom view of an exemplary radiating waveguide antenna cell of the exemplary waveguide antenna element based beam forming phased array antenna system for millimeter wave communication of FIG. 1A, in accordance with an exemplary embodiment of the disclosure.

FIG. 3B depicts a schematic bottom view of an exemplary radiating waveguide antenna cell of the exemplary waveguide antenna element based beam forming phased array antenna system of FIG. 1A, in accordance with an exemplary embodiment of the disclosure. With reference to FIG. 3B, there is shown a schematic bottom view of the radiating waveguide antenna cell 102A of FIG. 2B. There is shown the first end 210 of the radiating waveguide antenna cell 102A. The first end 210 may be the lower end 212 of the plurality of pins 206 depicting positive and negative terminals. The plurality of pins 206 in the radiating waveguide antenna cell 102A includes a pair of vertical polarization pins 302*a* and 302*b* that acts as a first positive terminal and a first negative terminal. The plurality of pins 206 in the radiating waveguide antenna cell 102A further includes a pair of horizontal polarization pins 304*a* and 304*b* that acts as a second positive terminal and a second negative terminal. The pair of vertical polarization pins 302*a* and 302*b* and the pair of horizontal polarization pins 304*a* and 304*b* are utilized for dual-polarization. Thus, the waveguide antenna element based beam forming phased array 100A may be a dual-polarized open waveguide array antenna configured to transmit and receive radio frequency (RF) waves for the millimeter wave communication in both horizontal and vertical polarizations. In some embodiments, the waveguide antenna element based beam forming phased array 100A may be a dual-polarized open waveguide array antenna configured to transmit and receive radio frequency (RF) waves in also left hand circular polarization (LHCP) or right hand circular polarization (RHCP), known in the art. The circular polarization is known in the art, where an electromagnetic wave is in a polarization state, in which electric field of the electromagnetic wave exhibits a constant magnitude. However, the direction of the electromagnetic wave may rotate with time at a steady rate in a plane perpendicular to the direction of the electromagnetic wave.

Figure 4A:
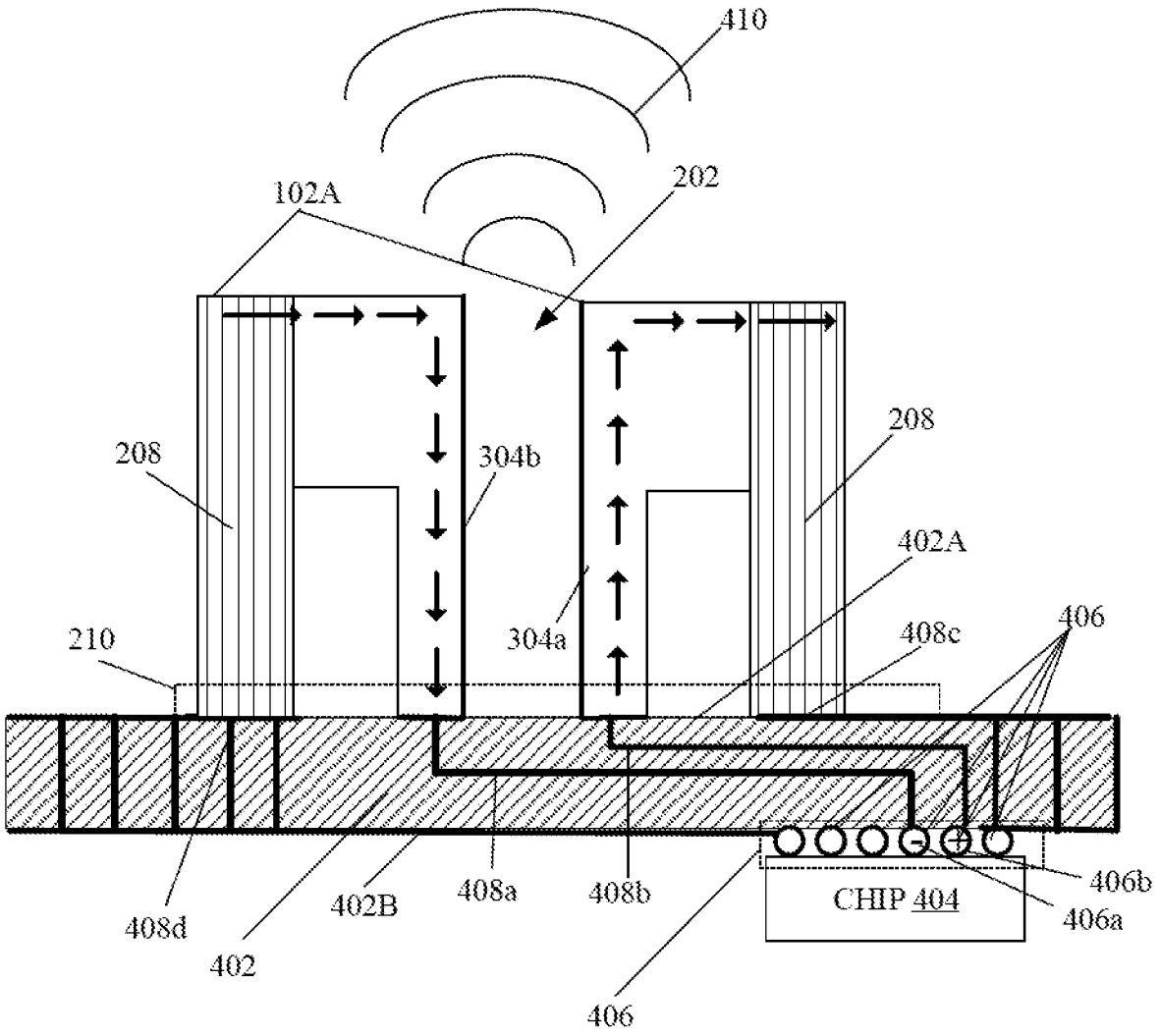
FIG. 4A illustrates a first exemplary antenna system that depicts a cross-sectional side view of the exemplary radiating waveguide antenna cell of FIG. 2A mounted on a substrate, in accordance with an exemplary embodiment of the disclosure.

FIG. 4A illustrates a first exemplary antenna system that depicts a cross-sectional side view of the exemplary radiating waveguide antenna cell of FIG. 2A mounted on a substrate, in accordance with an exemplary embodiment of the disclosure. With reference to FIG. 4A, there is shown a cross-sectional side view of the ground 208 and two pins, such as the first pair of horizontal polarization pins 304*a* and 304*b*, of the radiating waveguide antenna cell 102A. There is also shown a first substrate 402, a chip 404, and a plurality of connection ports 406 provided on the chip 404. The plurality of connection ports 406 may include at least a negative terminal 406*a* and a positive terminal 406*b*. There is further shown electrically conductive routing connections 408*a*, 408*b*, 408*c*, and 408*d*, from the plurality of connection ports 406 of the chip 404 to the waveguide antenna, such as the first pair of horizontal polarization pins 304*a* and 304*b* and the ground 208. There is also shown a radio frequency (RF) wave 410 radiated from the open end 202 of the radiating waveguide antenna cell 102A.

As the first pair of horizontal polarization pins 304*a* and 304*b* protrude slightly from the first end 210 from the level of the body (i.e., the ground 208) of the radiating waveguide antenna cell 102A, a firm contact with the first substrate 402 may be established. The first substrate 402 comprises an upper side 402A and a lower side 402B. The first end 210 of the plurality of radiating waveguide antenna cells 102, such as the radiating waveguide antenna cell 102A, of the waveguide antenna element based beam forming phased array 100A may be mounted on the upper side 402A of the first substrate 402. Thus, the waveguide antenna element based beam forming phased array 100A may also be referred to as a surface mount open waveguide antenna. In some embodiments, the chip 404 may be positioned beneath the lower side 402B of the first substrate 402. In operation, the current may flow from the ground 208 towards the negative terminal 406*a* of the chip 404 through at least a first pin (e.g., the pin 304*b* of the first pair of horizontal polarization pins 304*a* and 304*b*), and the electrically conductive connection 408*a*. Similarly, the current may flow from the positive terminal 406*b* of the chip 404 towards the ground 208 through at least a second pin (e.g., the pin 304*a* of the first pair of horizontal polarization pins 304*a* and 304*b*) of the plurality of pins 206 in the radiating waveguide antenna cell 102A. This forms a closed circuit, where the flow of current in the opposite direction in closed circuit within the radiating waveguide antenna cell 102A in at least one polarization creates a magnetic dipole and differential in at least two electromagnetic waves resulting in propagation of the RF wave 410 via the open end 202 of the radiating waveguide antenna cell 102A. The chip 404 may be configured to form a RF beam and further control the propagation and a direction of the RF beam in millimeter wave frequency through the open end 202 of each radiating waveguide antenna cell by adjusting signal parameters of RF signal (i.e. the radiated RF wave 410) emitted from each radiating waveguide antenna cell of the plurality of radiating waveguide antenna cells 102.

In accordance with an embodiment, each radiating waveguide antenna cell of the plurality of radiating waveguide antenna cells 102 may further be configured to operate within multiple frequency ranges in the field of millimeter wave-based wireless communication. For example, each radiating waveguide antenna cell may be configured to operate as a dual-band antenna. Each radiating waveguide antenna cell may be configured to operate in high band resonant frequency with a range of 37-40.5 GHz and low band resonant frequency with a range of 26.5-29.5 GHz. By designing a radiating waveguide antenna cell to operate as a dual-band antenna, multiple companies may benefit from the disclosed design of the radiating waveguide antenna cell. For example, Verizon may operate with the low band resonant frequency with the range of 26.5-29.5 GHz and AT&T may operate with the high band resonant frequency with the range of 37-40.5 GHz. Consequently, a single radiating waveguide antenna cell may be used by both the service providers (Verizon and AT&T). In accordance with an embodiment, the communication elements, such as transmitters and receivers may also cover the dual bands (for example, the high band resonant frequency and the low band resonant frequency). The advantage of dual band is both band share the antenna which saves designing cost and the overall power requirements. The gain and the radiation efficiency may be same in both bands. Accordingly, the gain and the radiation efficiency of the radiating waveguide antenna cell that operates with the dual band may remain the same for the high band resonant frequency and the low band resonant frequency.

Figure 4B:
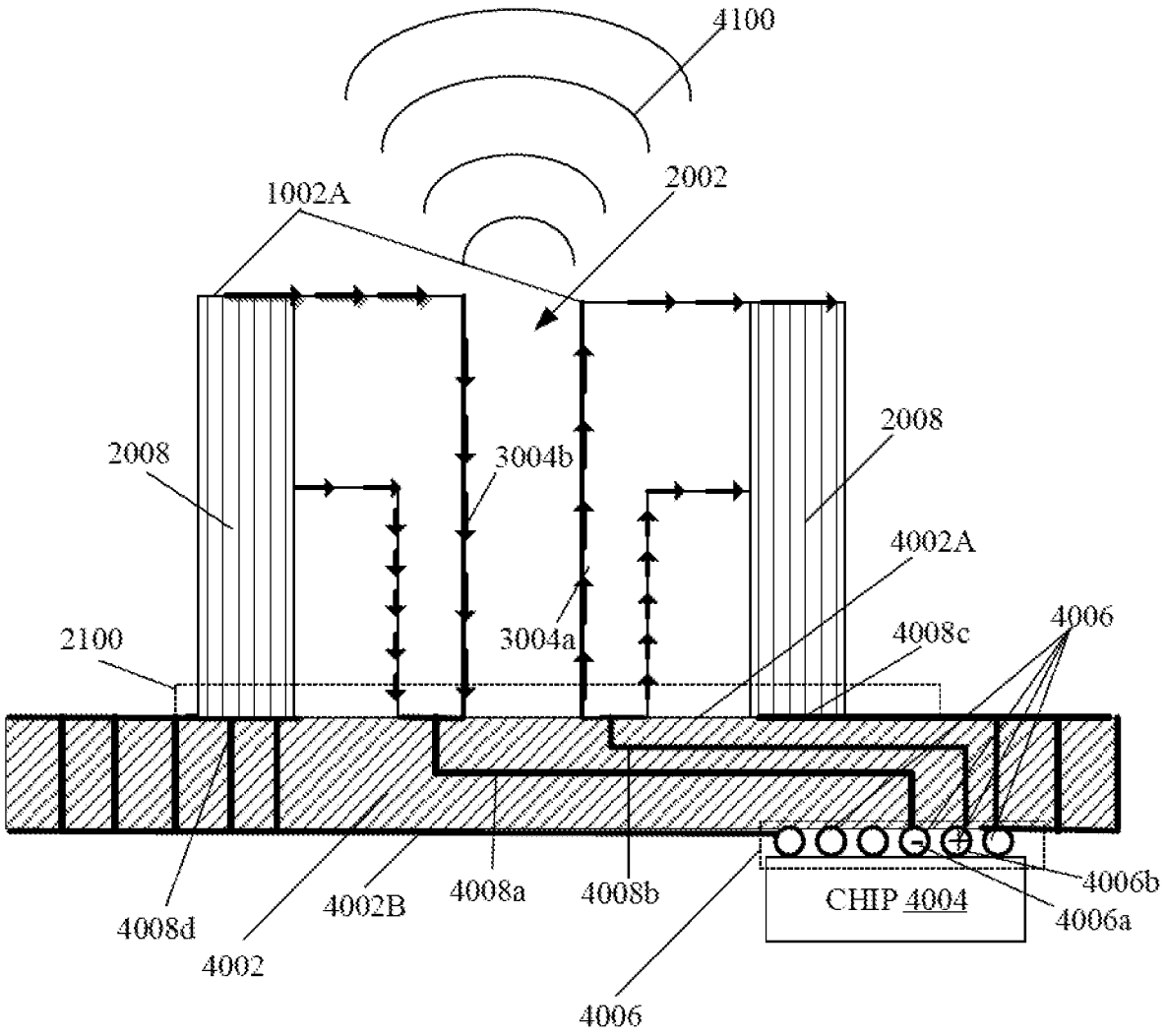
FIG. 4B illustrates a second exemplary antenna system that depicts a cross-sectional side view of an exemplary radiating waveguide antenna cell of FIG. 2A mounted on a substrate, in accordance with an exemplary embodiment of the disclosure.

FIG. 4B illustrates a second exemplary antenna system that depicts a cross-sectional side view of an exemplary radiating waveguide antenna cell of FIG. 2A mounted on a substrate, in accordance with an exemplary embodiment of the disclosure. With reference to FIG. 4B, there is shown a cross-sectional side view of the ground 2008 and two pins, such as the first pair of horizontal polarization pins 3004*a* and 3004*b*, of the radiating waveguide antenna cell 1002A. There is also shown a first substrate 4002, a chip 4004, and a plurality of connection ports 4006 provided on the chip 4004. The plurality of connection ports 4006 may include at least a negative terminal 4006*a* and a positive terminal 4006*b*. There is further shown electrically conductive routing connections 4008*a*, 4008*b*, 4008*c*, and 4008*d*, from the plurality of connection ports 4006 of the chip 4004 to the waveguide antenna, such as the first pair of horizontal polarization pins 3004*a* and 3004*b* and the ground 2008. There is also shown a radio frequency (RF) wave 4100 radiated from the open end 2002 of the radiating waveguide antenna cell 1002A.

In accordance with an embodiment, the radiating waveguide antenna cell 1002A may be configured to operate in dual band. In accordance with an embodiment, each of the first pair of horizontal polarization pins 3004*a* and 3004*b* comprises a first current path and a second current path. The first current path is longer than the second current path. Since the frequency of an antenna is inversely proportional to wavelength of the antenna, the first current path may correspond to the low band resonant frequency of the radiating waveguide antenna cell 1002A and the second current path may correspond to the high band resonant frequency of the radiating waveguide antenna cell 1002A. In accordance with an embodiment the chip 4004 may operate as a dual-band chip. The chip 4004 may be configured to generate a high band RF signal and a low band RF signal at the transmitter and at the receiver. The high band RF signal may have the high band resonant frequency and the low band RF signal may have the low band resonant frequency.

In operation, the radiating waveguide antenna cell 1002A may operate with the high band resonant frequency and the low band resonant frequency. Accordingly, a low band RF current, via the first current path, and a high band RF current, via the second current path, may flow from the ground 2008 towards the negative terminal 4006*a* of the chip 4004 through at least a first pin (e.g., the pin 3004*b* of the first pair of horizontal polarization pins 30004*a* and 3004*b*), and the electrically conductive connection 4008*a*. Similarly, the low band RF current and the high band RF current may flow from the positive terminal 4006*b* of the chip 4004 towards the ground 2008 through at least a second pin (e.g., the pin 3004*a* of the first pair of horizontal polarization pins 3004*a* and 3004*b*) of the plurality of pins 2006 in the radiating waveguide antenna cell 1002A. This forms a closed circuit, where the flow of currents in the opposite direction in closed circuit within the radiating waveguide antenna cell 1002A in at least one polarization creates a magnetic dipole and differential in at least two electromagnetic waves resulting in propagation of the RF wave 4100 via the open end 2002 of the radiating waveguide antenna cell 1002A. Since the high band RF current flows through a shorter path, the high band RF current may result in the propagation of the high band RF signal and the low band RF current flows through a shorter path and the low band RF current may result in the propagation of the low band RF signal. In accordance with an embodiment, the directions of the flow of the low band RF current in the first current path and the high band RF current in the second current path are same. The chip 4004 may be configured to form two RF beams (for example, a high band RF beam and a low band RF beam) and further control the propagation and direction of the high band RF beam and the low band RF beam in millimeter wave frequency through the open end 2002 of each radiating waveguide antenna cell by adjusting signal parameters of RF signal (i.e. the radiated RF wave 4100) emitted from each radiating waveguide antenna cell of the plurality of radiating waveguide antenna cells 102.

Figure 4C:
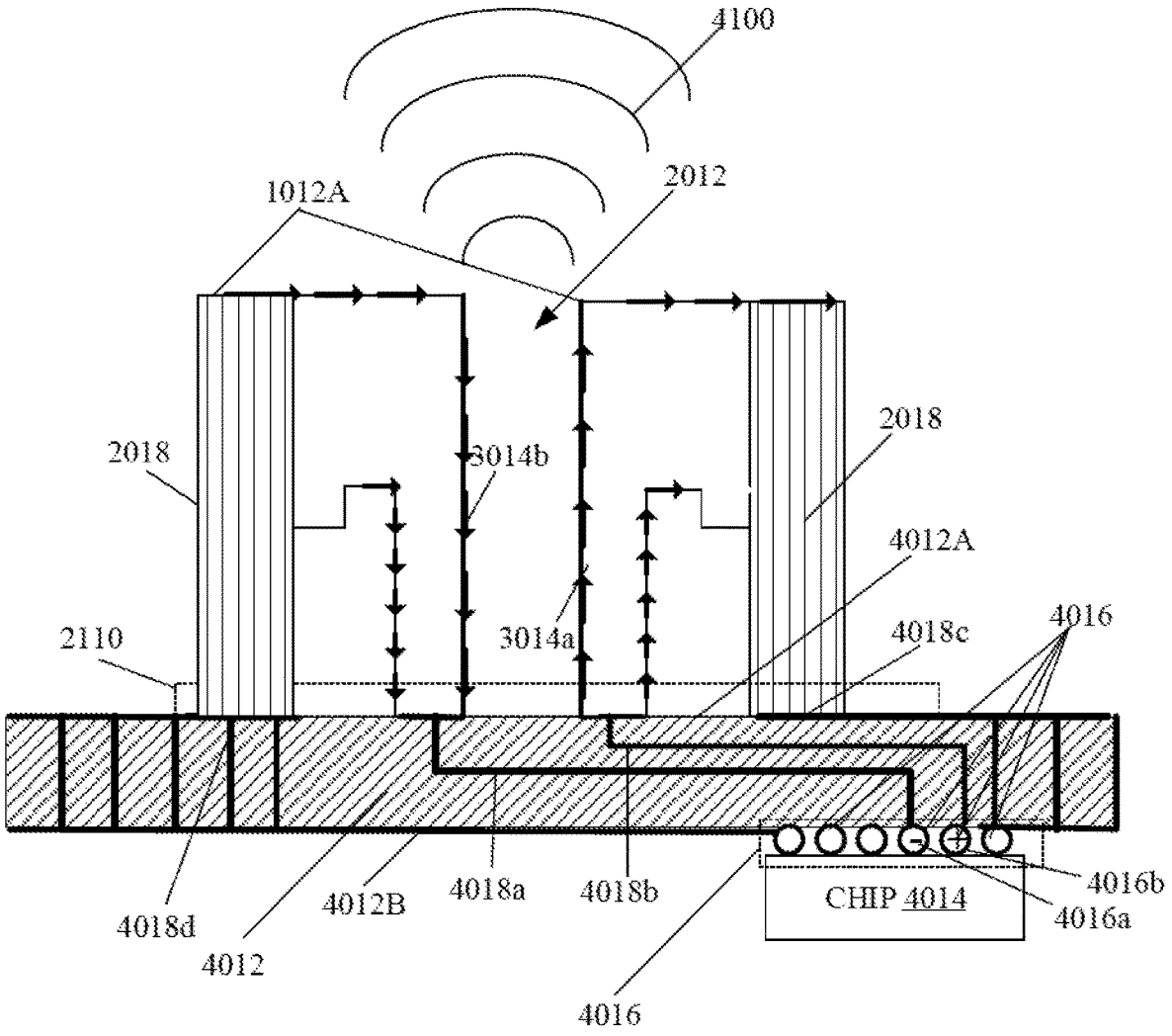
FIG. 4C illustrates a third exemplary antenna system that depicts a cross-sectional side view of an exemplary radiating waveguide antenna cell of FIG. 2A mounted on a substrate, in accordance with an exemplary embodiment of the disclosure.

FIG. 4C illustrates a third exemplary antenna system that depicts a cross-sectional side view of an exemplary radiating waveguide antenna cell of FIG. 2A mounted on a substrate, in accordance with an exemplary embodiment of the disclosure. With reference to FIG. 4C, there is shown a cross-sectional side view of the ground 2018 and two pins, such as the first pair of horizontal polarization pins 3014*a* and 3014*b*, of the radiating waveguide antenna cell 1012A. There is also shown a first substrate 4012, a chip 4014, and a plurality of connection ports 4016 provided on the chip 4014. The plurality of connection ports 4016 may include at least a negative terminal 4016*a* and a positive terminal 4016*b*. There is further shown electrically conductive routing connections 4018*a*, 4018*b*, 4018*c*, and 4018*d*, from the plurality of connection ports 4016 of the chip 4014 to the waveguide antenna, such as the first pair of horizontal polarization pins 3014*a* and 3014*b* and the ground 2018. There is also shown a RF wave 4100 radiated from the open end 2012 of the radiating waveguide antenna cell 1012A. In accordance with an embodiment, the radiating waveguide antenna cell 1012A may be configured to operate in dual band such that there is a variation in a shape of the radiating waveguide antenna cell 1012A to generate the high band RF current corresponding to the high band resonant frequency. The intensity of the high band RF current may correspond to a size of the radiating waveguide antenna cell 1012A. By a variation in the size of the radiating waveguide antenna cell 1012A, the high band resonant frequency corresponding to the high band RF current may be obtained. Accordingly, the radiating waveguide antenna cell 1012A acts as a dual band with the high band resonant frequency in the range of 37-40.5 GHz and the low band resonant frequency in the range of 26.5-29.5 GHz.

In operation, the radiating waveguide antenna cell 1012A may operate with the high band resonant frequency and the low band resonant frequency. The magnitude of the high band resonant frequency is based on the size of the radiating waveguide antenna cell 1012A. Since the frequency of the radiating waveguide antenna cell 1012A is inversely proportional to the wavelength of the radiating waveguide antenna cell 1012A, by varying the size of the radiating waveguide antenna cell 1012A a high band resonant frequency is obtained. Accordingly, the low band RF current and the high band RF current may flow from the ground 2018 towards the negative terminal 4016*a* of the chip 4014 through at least a first pin (e.g., the pin 3014*b* of the first pair of horizontal polarization pins 3014*a* and 3014*b*), and the electrically conductive connection 4018*a*. Similarly, the low band RF current and the high band RF current may flow from the positive terminal 4016*b* of the chip 4014 towards the ground 2018 through at least a second pin (e.g., the pin 3014*a* of the first pair of horizontal polarization pins 3014*a* and 3014*b*) of the plurality of pins 2016 in the radiating waveguide antenna cell 1012A. This forms a closed circuit, where the flow of currents in the opposite direction in a closed circuit within the radiating waveguide antenna cell 1012A in at least one polarization creates a magnetic dipole and differential in at least two electromagnetic waves resulting in propagation of the RF wave 4100 via the open end 2012 of the radiating waveguide antenna cell 1012A. The chip 4014 may be configured to form two RF beams (for example, the high band RF beam and the low band RF beam) and further control the propagation and direction of the high band RF beam and the low band RF beam in millimeter wave frequency through the open end 2012 of each radiating waveguide antenna cell by adjusting signal parameters of RF signal (i.e. the radiated RF wave 4100) emitted from each radiating waveguide antenna cell of the plurality of radiating waveguide antenna cells 102.

Figure 5A:
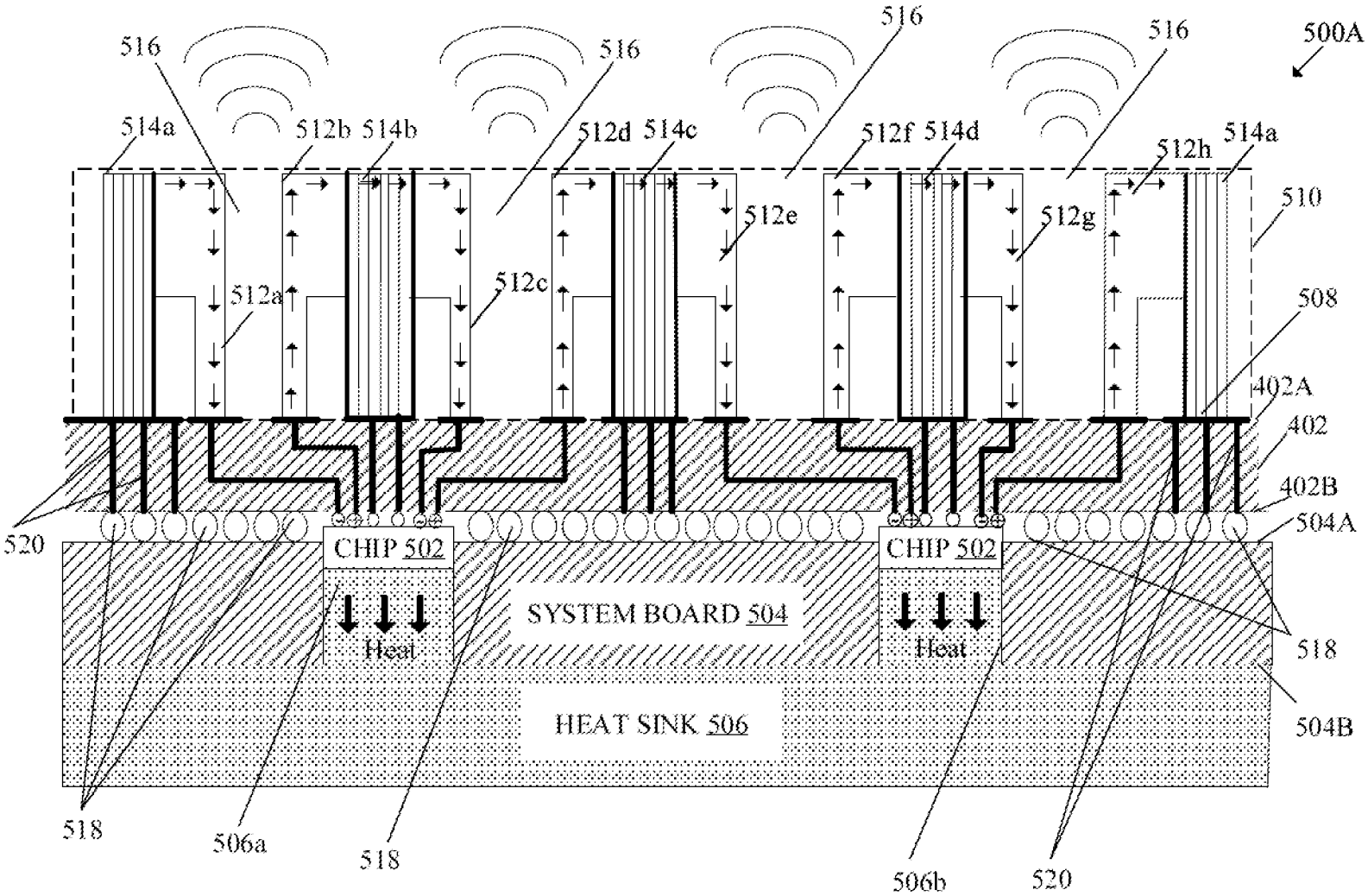
FIG. 5A illustrates various components of a first exemplary antenna system, in accordance with an exemplary embodiment of the disclosure.

FIG. 5A illustrates various components of a first exemplary antenna system, in accordance with an exemplary embodiment of the disclosure. With reference to FIG. 5A, there is shown a cross-sectional side view of an antenna system 500A. The antenna system 500A may comprise the first substrate 402, a plurality of chips 502, a main system board 504, and a heat sink 506. There is further shown a cross-sectional side view of the waveguide antenna element based beam forming phased array 100A in two dimension (2D).

In accordance with an embodiment, a first end 508 of a set of radiating waveguide antenna cells 510 of the waveguide antenna element based beam forming phased array 100A (as the unitary body) may be mounted on the first substrate 402. For example, in this case, the first end 508 of the set of radiating waveguide antenna cells 510 of the waveguide antenna element based beam forming phased array 100A is mounted on the upper side 402A of the first substrate 402. The plurality of chips 502 may be positioned between the lower side 402B of the first substrate 402 and the upper surface 504A of the system board 504. The set of radiating waveguide antenna cells 510 may correspond to certain number of radiating waveguide antenna cells, for example, four radiating waveguide antenna cells, of the plurality of radiating waveguide antenna cells 102 (FIG. 1A) shown in the side view. The plurality of chips 502 may be electrically connected with the plurality of pins (such as pins 512*a* to 512*h*) and the ground (ground 514*a* to 514*d*) of each of the set of radiating waveguide antenna cells 510 to control beamforming through a second end 516 of each of the set of radiating waveguide antenna cells 510 for the millimeter wave communication. Each of the plurality of chips 502 may include a plurality of connection ports (similar to the plurality of connection ports 406 of FIG. 4A). The plurality of connection ports may include a plurality of negative terminals and a plurality of positive terminals (represented by "+" and "−" charges). A plurality of electrically conductive routing connections (represented by thick lines) are provided from the plurality of connection ports of the plurality of chips 502 to the waveguide antenna elements, such as the pins 512*a* to 512*h* and the ground 514*a* to 514*d* of each of the set of radiating waveguide antenna cells 510.

In accordance with an embodiment, the system board 504 includes an upper surface 504A and a lower surface 504B. The upper surface 504A of the system board 504 comprises a plurality of electrically conductive connection points 518 (e.g., solder balls) to connect to the ground (e.g., the ground 514*a* to 514*d*) of each of set of radiating waveguide antenna cells 510 of the waveguide antenna element based beam forming phased array 100A using electrically conductive wiring connections 520 that passes through the first substrate 402. The first substrate 402 may be positioned between the waveguide antenna element based beam forming phased array 100A and the system board 504.

In accordance with an embodiment, the heat sink 506 may be attached to the lower surface 504B of the system board 504. The heat sink may have a comb-like structure in which a plurality of protrusions (such as protrusions 506*a* and 506*b*) of the heat sink 506 passes through a plurality of perforations in the system board 504 such that the plurality of chips 502 are in contact to the plurality of protrusions (such as protrusions 506*a* and 506*b*) of the heat sink 506 to dissipate heat from the plurality of chips 502 through the heat sink 506.

Figure 5B:
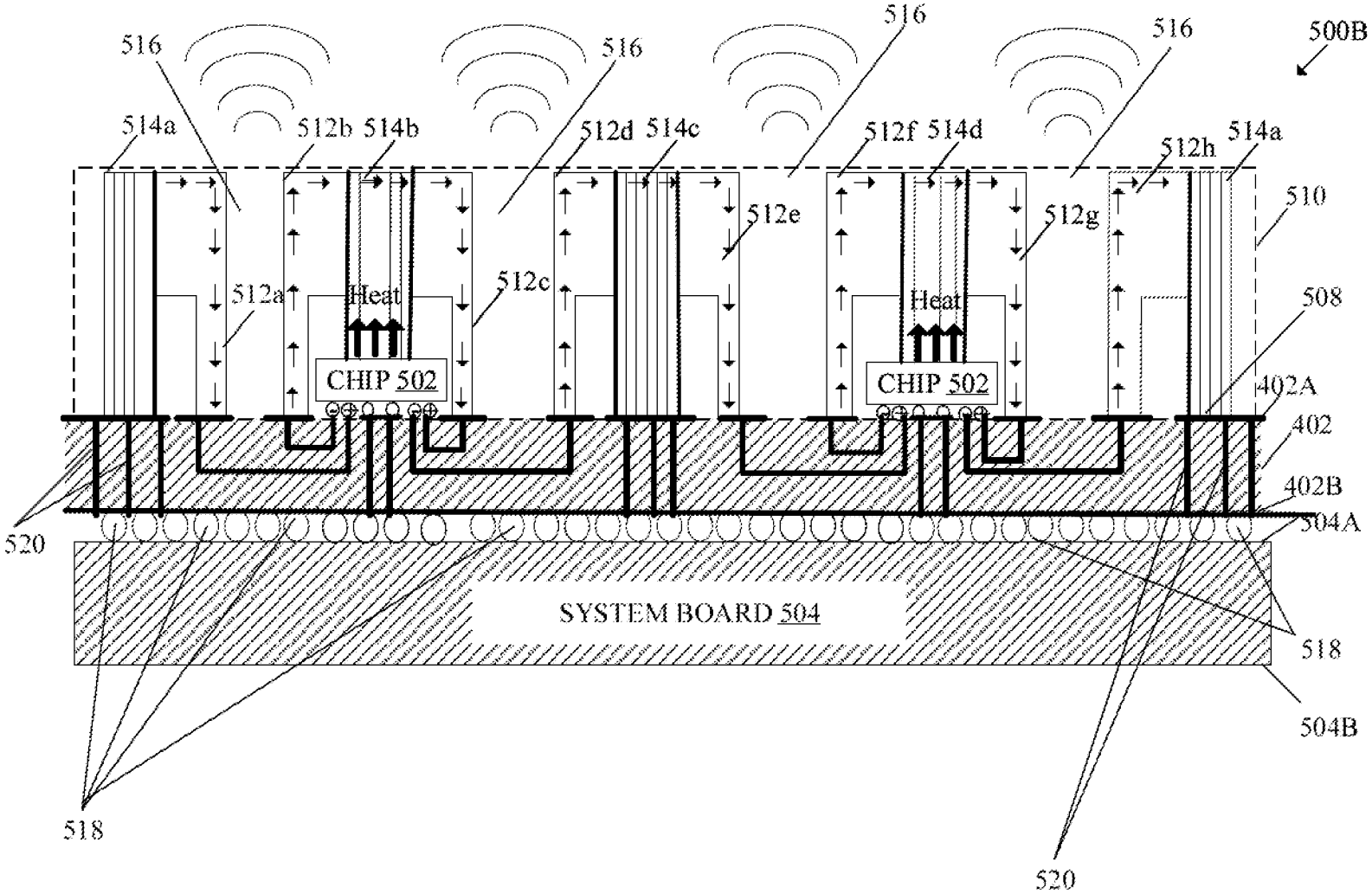
FIG. 5B illustrates various components of a second exemplary antenna system, in accordance with an exemplary embodiment of the disclosure.

FIG. 5B illustrates various components of a second exemplary antenna system, in accordance with an exemplary embodiment of the disclosure. With reference to FIG. 5B, there is shown a cross-sectional side view of an antenna system 500B that depicts a cross-sectional side view of the waveguide antenna element based beam forming phased array 100A in 2D. The antenna system 500B may comprise the first substrate 402, the plurality of chips 502, the main system board 504, and other elements as described in FIG. 5A except a dedicated heat sink (such as the heat sink 506 of FIG. 5A).

In some embodiments, as shown in FIG. 5B, the plurality of chips 502 may be on the upper side 402A of the first substrate 402 (instead of the lower side 402B as shown in FIG. 5A). Thus, the plurality of chips 502 and the plurality of radiating waveguide antenna cells 102 (such as the set of radiating waveguide antenna cells 510) of the waveguide antenna element based beam forming phased array 100A may be positioned on the upper side 402A of the first substrate 402. Alternatively stated, the plurality of chips 502 and the waveguide antenna element based beam forming phased array 100A may lie on the same side (i.e., the upper side 402A) of the first substrate 402. Such positioning of the plurality of radiating waveguide antenna cells 102 of the waveguide antenna element based beam forming phased array 110A and the plurality of chips 502 on a same side of the first substrate 402, is advantageous, as insertion loss (or routing loss) between the first end 508 of the plurality of radiating waveguide antenna cells of the waveguide antenna element based beam forming phased array 110A and the plurality of chips 502 is reduced to minimum. Further, when the plurality of chips 502 and the waveguide antenna element based beam forming phased array 100A are present on the same side (i.e., the upper side 402A) of the first substrate 402, the plurality of chips 502 are in physical contact to the waveguide antenna element based beam forming phased array 100A. Thus, the unitary body of the waveguide antenna element based beam forming phased array 100A that has a metallic electrically conductive surface acts as a heat sink to dissipate heat from the plurality of chips 502 to atmospheric air through the metallic electrically conductive surface of the waveguide antenna element based beam forming phased array 110A. Therefore, no dedicated metallic heat sink (such as the heat sink 506), may be required, which is cost-effective. The dissipation of heat may be based on a direct and/or indirect contact (through electrically conductive wiring connections) of the plurality of chips 502 with the plurality of radiating waveguide antenna cells of the waveguide antenna element based beam forming phased array 110A on the upper side 402A of the first substrate 402.

Figure 5C:
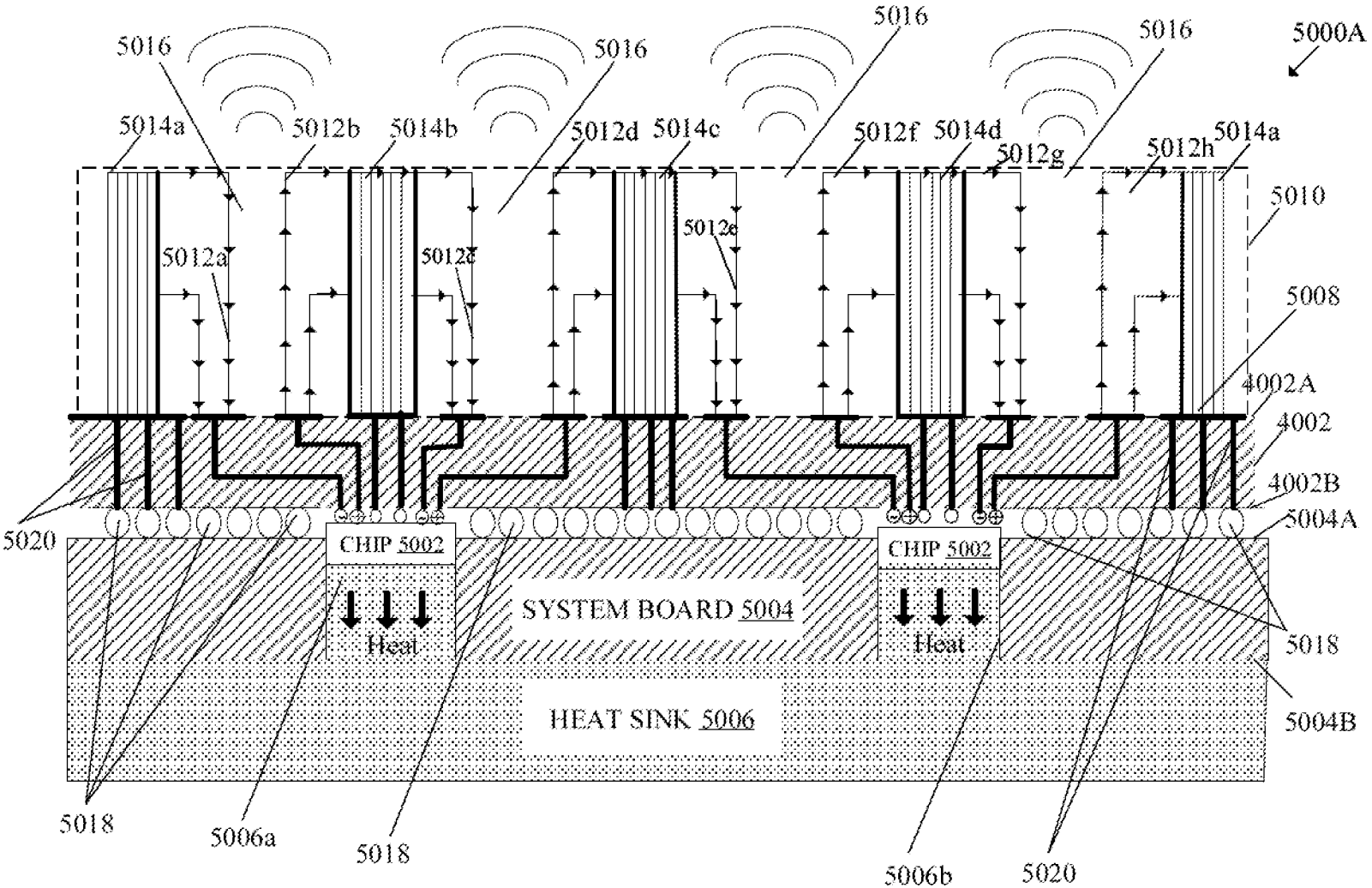
FIG. 5C illustrates various components of a third exemplary antenna system, in accordance with an exemplary embodiment of the disclosure.

FIG. 5C illustrates various components of a third exemplary antenna system, in accordance with an exemplary embodiment of the disclosure. Dual band dual polarization antenna can be integrated in an element. With reference to FIG. 5C, there is shown a cross-sectional side view of an antenna system 5000A. The antenna system 5000A may comprise the first substrate 4002, a plurality of chips 5002, a main system board 5004, and a heat sink 5006. The antenna system 5000A corresponds to a cross-sectional side view of the waveguide antenna element based beam forming phased array 100A in two dimension (2D).

In accordance with an embodiment, a first end 5008 of a set of radiating waveguide antenna cells 5010 of the waveguide antenna element based beam forming phased array 100A (as the unitary body) may be mounted on the first substrate 4002. For example, in this case, the first end 5008 of the set of radiating waveguide antenna cells 5010 of the waveguide antenna element based beam forming phased array 100A is mounted on the upper side 4002A of the first substrate 4002. The plurality of chips 5002 may be positioned between the lower side 4002B of the first substrate 4002 and the upper surface 5004A of the system board 5004. The set of radiating waveguide antenna cells 5010 may correspond to certain number of radiating waveguide antenna cells, for example, four of the radiating waveguide antenna cell 1002A (FIG. 4B) shown in the side view. In accordance with an embodiment, the set of radiating waveguide antenna cells 5010 may correspond to a certain number of radiating waveguide antenna cells, for example, four of the radiating waveguide antenna cell 1012A (FIG. 4C) shown in the side view. Each pair of the plurality of pins (such as pins 5012*a* to 5012*h*) may correspond to the pair of horizontal polarization pins 304*a* and 304*b*. In accordance with an embodiment, each pair of the plurality of pins (such as pins 5012*a* to 5012*h*) may correspond to the pair of vertical polarization pins 302*a* and 302*b*. The plurality of chips 5002 may be electrically connected with the plurality of pins (such as pins 5012*a* to 5012*h*) and the ground (ground 5014*a* to 5014*d*) of each of the set of radiating waveguide antenna cells 5010 to control beamforming through a second end 5016 of each of the set of radiating waveguide antenna cells 5010 for the propagation of the high band RF beam and the low band RF beam in the millimeter wave communication. Each of the plurality of chips 5002 may include a plurality of connection ports (similar to the plurality of connection ports 4006 of FIG. 4B). The plurality of connection ports may include a plurality of negative terminals and a plurality of positive terminals (represented by "+" and "−" charges). A plurality of electrically conductive routing connections (represented by thick lines) are provided from the plurality of connection ports of the plurality of chips 5002 to the waveguide antenna elements, such as the pins 5012*a* to 5012*h* and the ground 5014*a* to 5014*d* of each of the set of radiating waveguide antenna cells 5010.

In accordance with an embodiment, the system board 5004 may be similar to the system board 504 and the heat sink 5006 may be similar to the heat sink 506 of FIG. 5A. The various components of the antenna system 5000A may be arranged similar to either of the arrangement of various components of the antenna system 500A or the antenna system 500B without deviating from the scope of the invention.

Figure 5D:
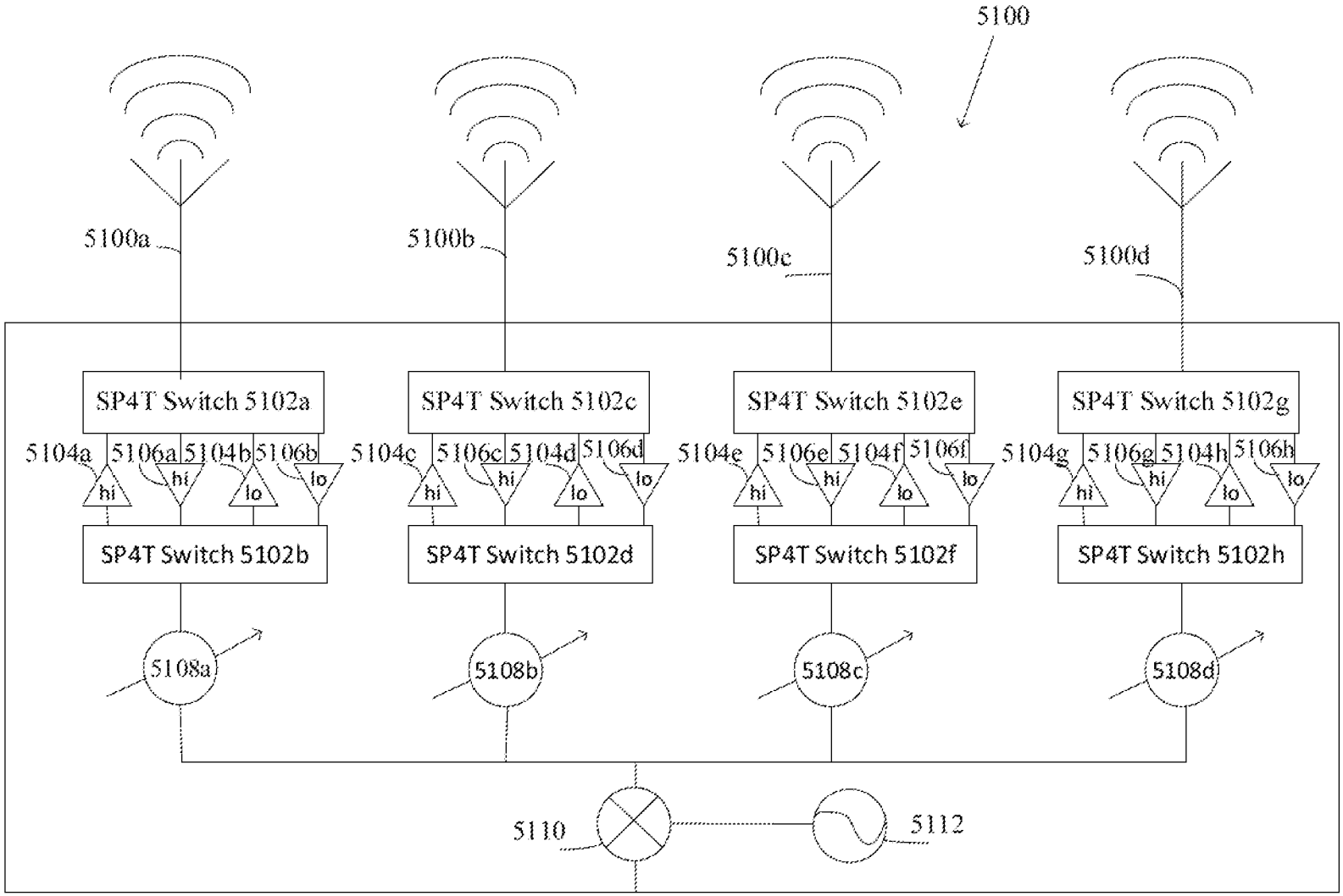
FIG. 5D illustrates a block diagram of a dual band waveguide antenna system for millimeter wave communication, in accordance with an exemplary embodiment of the disclosure.

FIG. 5D illustrates a block diagram of the dual band waveguide antenna system for the millimeter wave communication, in accordance with an exemplary embodiment of the disclosure. FIG. 5D is described in conjunction with elements of FIGS. 1A, 1B, 2A, 2B, 3A, 3B, 4B, 4C, and 5A-5C. With reference to FIG. 5D, there is shown dual band transmitter receiver shared antenna system 5100. The dual band transmitter receiver shared antenna system 5100 may be similar to the antenna system 5000A of FIG. 5C. The dual band transmitter receiver shared antenna system 5100 further includes a plurality of dual band transmitter receiver shared antennas 5100*a* to 5100*d*, a plurality of single pole, 4 throw (SP4T) switches (SP4T 5102*a* to 5102*h*), a set of high band power amplifiers (power amplifier 5104*a*, 5104*c*, 5104*e*, and 5104g), a set of low band power amplifiers (amplifier 5104*b*, 5104*d*, 5104*f*, and 5104*h*), a set of high band low noise amplifier (low noise amplifier 5106*a*, 5106*c*,

5106*e*, and 5106*g*), a set of low band low noise amplifier (low amplifier 5106*b*, 5106*d*, 5106*f*, and 5106*h*), a set of phase shifters (phase shifter 5108*a* to 5108*d*), a mixer 5110 and a local oscillator 5112 in addition to the various components of the antenna system 5000A as described in FIG. 5C. Since each antenna is a dual band transmitter receiver shared antenna, all the plurality of dual band transmitter receiver shared antennas 5100*a* to 5100*d* are configured to transmit and receive dual band resonant frequencies in high band with the range of 37-40.5 GHz and low band with the range of 26.5-29.5 GHz.

In operation, for transmission of a RF signal, the RF signal may be mixed with a signal from the local oscillator 5112 by the mixer 5110. A phase of the mixed RF signal may be changed by one phase shifter of the set of phase shifters (phase shifter 5108*a* to 5108*d*). The phase shifted RF signal may then be supplied to a low band power amplifier or a high band power amplifier based on whether the dual band transmitter receiver shared antenna is operating to transmit the low band resonant frequency or the high band resonant frequency. The selection of the low band power amplifier or the high band power amplifier is performed by the SP4T switch. For reception, an incoming RF signal may be received by the dual band transmitter receiver shared antenna. The received RF signal may then flow through one of the high band low noise amplifier or the low band low noise amplifier based on whether the incoming RF signal corresponds to the high band resonant frequency or the low band resonant frequency. The selection of the high band low noise amplifier or the low band low noise amplifier is performed by the SP4T switch. The phase of the incoming RF signal is shifted and mixed with a local oscillator frequency. These operations may allow the receiver to be tuned across a wide band of interest, such that the frequency of the received RF signal is converted to a known, fixed frequency. This allows the received RF signal of interest to be efficiently processed, filtered, and demodulated.

Figure 5E:
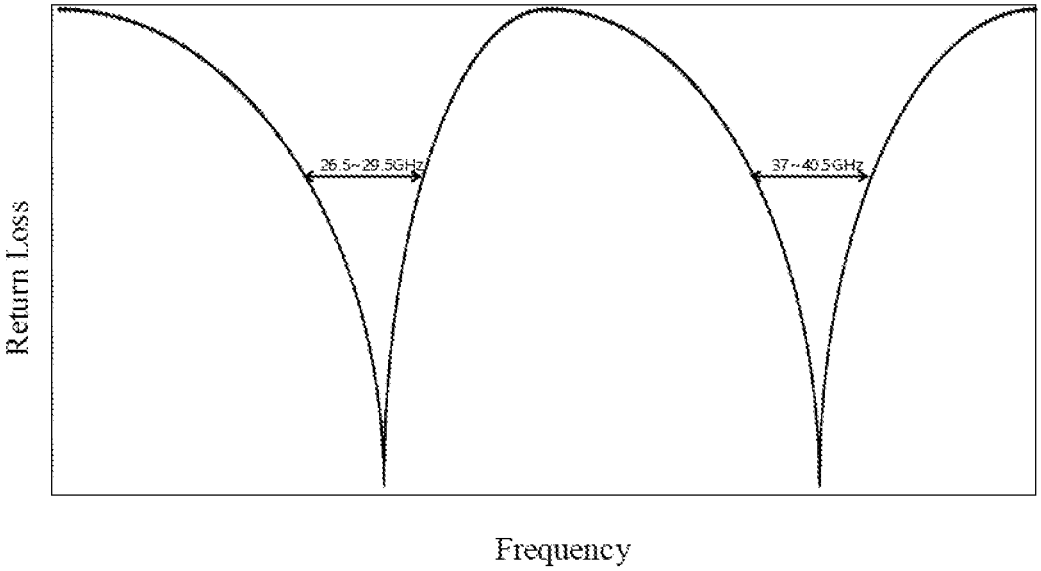
FIG. 5E illustrates a frequency response curve of the dual band waveguide antenna system for millimeter wave communication, in accordance with an exemplary embodiment of the disclosure.

FIG. 5E illustrates a frequency response curve of the dual band waveguide antenna system for millimeter wave communication, in accordance with an exemplary embodiment of the disclosure. FIG. 5E is described in conjunction with elements of FIGS. 1A, 1B, 2A, 2B, 3A, 3B, and 4B, 4C to 5A-5D. The frequency response curve may look substantially identical to that shown in FIG. 5E. The first resonant frequency and the second resonant frequency of the dual band antenna devices in FIGS. 4B, 4C, 5C and 5D may correspond to the low band resonant frequency with the range of 26.5-29.5 GHz and the high band resonant frequency with the range of 37-40.5 GHz as shown in FIG. 5E. It may be observed from the frequency response curve that the matching of the dual band waveguide antenna at the low band resonant frequency and at the high band resonant frequency is good with substantially low return loss. The matching at frequencies other than the low band resonant frequency and the high band resonant frequency is not good and has high return loss.

Figure 5F:
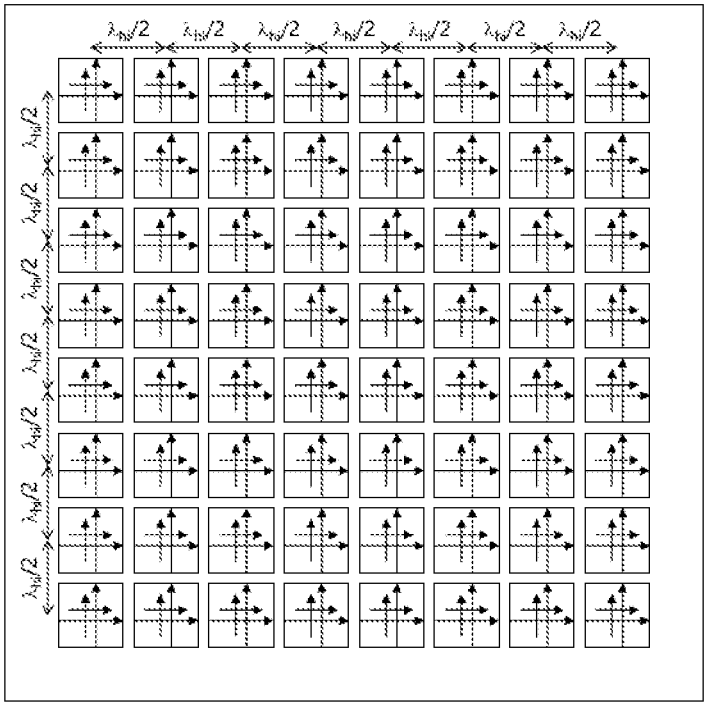
FIG. 5F depicts a perspective top view of an exemplary waveguide antenna element based beam forming phased array antenna system for millimeter wave communication, in accordance with an exemplary embodiment of the disclosure.

FIG. 5F depicts a perspective top view of an exemplary waveguide antenna element based beam forming phased array antenna system for millimeter wave communication, in accordance with an exemplary embodiment of the disclosure. With reference to FIG. 5F, there is shown a waveguide antenna element based beam forming phased array 100A. The waveguide antenna element based beam forming phased array 100A may have a unitary body that comprises a plurality of radiating waveguide antenna cells 102 arranged in a certain layout for millimeter wave communication. The unitary body refers to one-piece structure of the waveguide antenna element based beam forming phased array 100A, where multiple antenna elements, such as the plurality of radiating waveguide antenna cells 102 may be fabricated as a single piece structure. In FIG. 5F, an example of eight-by-eight waveguide array comprising sixty four radiating waveguide antenna cells, such as the radiating waveguide antenna cell 1002A or 1012A, in the first layout, is shown. In some embodiments, the waveguide antenna element based beam forming phased array 100A may be one-piece structure of four-by-four waveguide array comprising sixteen radiating waveguide antenna cells in the first layout. It is to be understood by one of ordinary skill in the art that the number of radiating waveguide antenna cells may vary, without departure from the scope of the present disclosure. For example, the waveguide antenna element based beam forming phased array 100A may be one-piece structure of N-by-N waveguide array comprising "M" number of radiating waveguide antenna cells arranged in certain layout, wherein "N" is a positive integer and "M" is N to the power of 2.

FIG. 5F illustrates the high band RF signal and the low band RF signal for the horizontal polarization pins and the high band RF signal and the low band RF signal for the vertical polarization pins. In accordance with an embodiment, the antenna element pitch may usually follow a half wavelength of the high band resonant frequency. In accordance with an embodiment, the antenna element pitch may follow a value between high and low band wavelength.

Figure 6:
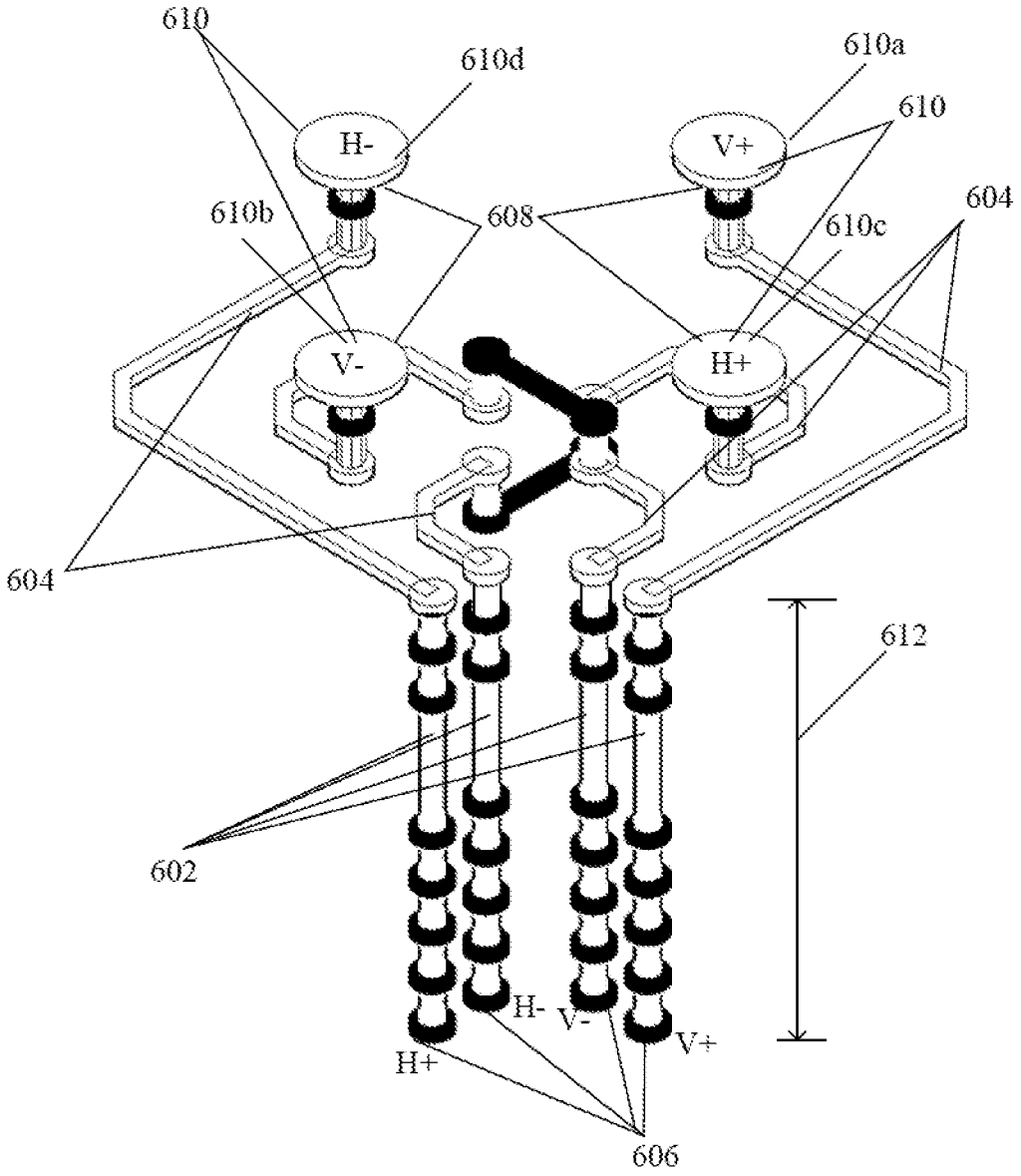
FIG. 6 illustrates radio frequency (RF) routings from a chip to an exemplary radiating waveguide antenna cell in the first exemplary antenna system of FIG. 5A, in accordance with an exemplary embodiment of the disclosure.

FIG. 6 illustrates radio frequency (RF) routings from a chip to an exemplary radiating waveguide antenna cell in the first exemplary antenna system of FIG. 5, in accordance with an exemplary embodiment of the disclosure. With reference to FIG. 6, there is shown a plurality of vertical routing connections 602 and a plurality of horizontal routing connections 604. The plurality of vertical routing connections 602 from the plurality of connection ports 606 provided on a chip (such as the chip 404 or one of the plurality of chips 502) are routed to a lower end 608 of a plurality of pins 610 of each radiating waveguide antenna cell. The plurality of pins 610 may correspond to the plurality of pins 206 of FIG. 2B.

In accordance with an embodiment, a vertical length 612 between the chip (such as the chip 404 or one of the plurality of chips 502) and a first end of each radiating waveguide antenna cell (such as the first end 210 of the radiating waveguide antenna cell 102A) of the plurality of radiating waveguide antenna cells 102, defines an amount of routing loss between each chip and the first end (such as the first end 210) of each radiating waveguide antenna cell. The first end of each radiating waveguide antenna cell (such as the first end 210 of the radiating waveguide antenna cell 102A) includes the lower end 608 of the plurality of pins 610 and the ground at the first end. When the vertical length 612 reduces, the amount of routing loss also reduces, whereas when the vertical length 612 increases, the amount of routing loss also increases. In other words, the amount of routing loss is directly proportional to the vertical length 612. Thus, in FIG. 5B, based on the positioning of the plurality of chips 502 and the waveguide antenna element based beam forming phased array 100A on the same side (i.e., the upper side 402A) of the first substrate 402, the vertical length 612 is negligible or reduced to minimum between the plurality of chips 502 and the first end 508 of the plurality of radiating waveguide antenna cells of the waveguide antenna element based beam forming phased array 110A. The vertical length 612 may be less than a defined threshold to reduce insertion loss (or routing loss)

for RF signals or power between the first end of each radiating waveguide antenna cell and the plurality of chips 502.

In FIG. 6, there is further shown a first positive terminal 610*a* and a first negative terminal 610*b* of a pair of vertical polarization pins of the plurality of pins 610. There is also shown a second positive terminal 610*c* and a second negative terminal 610*d* of a pair of horizontal polarization pins (such as the pins 512*b* and 512*c* of FIG. 5) of the plurality of pins 610. The positive and negative terminals of the plurality of connection ports 606 may be connected to a specific pin of specific and same polarization (as shown), to facilitate dual-polarization.

Figure 7:
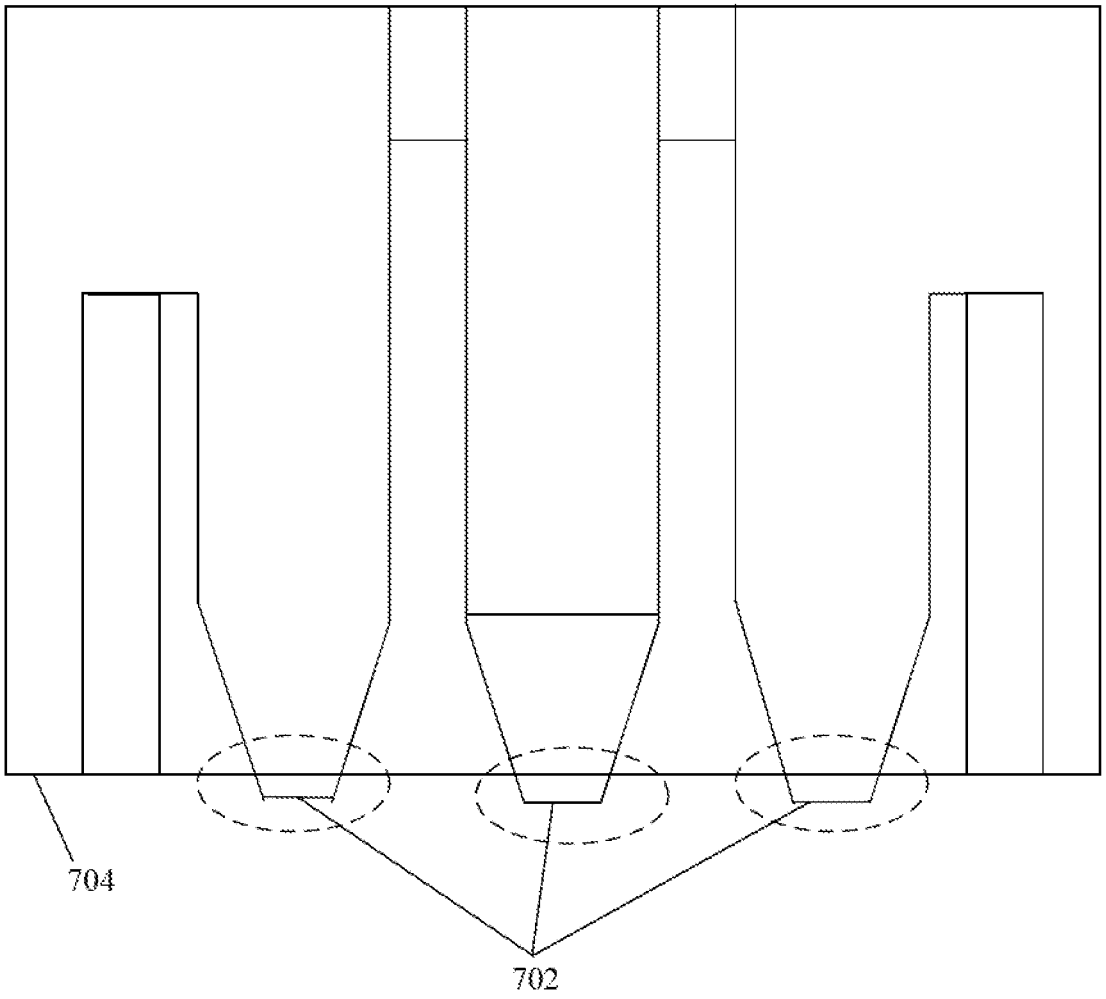
FIG. 7 illustrates protrude pins of an exemplary radiating waveguide antenna cell of an exemplary waveguide antenna array in an antenna system, in accordance with an exemplary embodiment of the disclosure.

FIG. 7 illustrates protrude pins of an exemplary radiating waveguide antenna cell of an exemplary waveguide antenna element based beam forming phased array in an antenna system, in accordance with an exemplary embodiment of the disclosure. With reference to FIG. 7, there is shown a plurality of protrude pins 702 that slightly protrudes from a level of the body 704 of a radiating waveguide antenna cell of the waveguide antenna element based beam forming phased array 100A. The plurality of protrude pins 702 corresponds to the plurality of pins 206 (FIG. 2B) and the pins 512*a* to 512*h* (FIG. 5). The body 704 corresponds to the ground 208 (FIGS. 2A and 2B) and the ground 514*a* to 514*d* (FIG. 5). The plurality of protrude pins 702 in each radiating waveguide antenna cell of the plurality of radiating waveguide antenna cells 102 advantageously secures a firm contact of each radiating waveguide antenna cell with the first substrate 402 (FIGS. 4A and 5).

Figure 8:
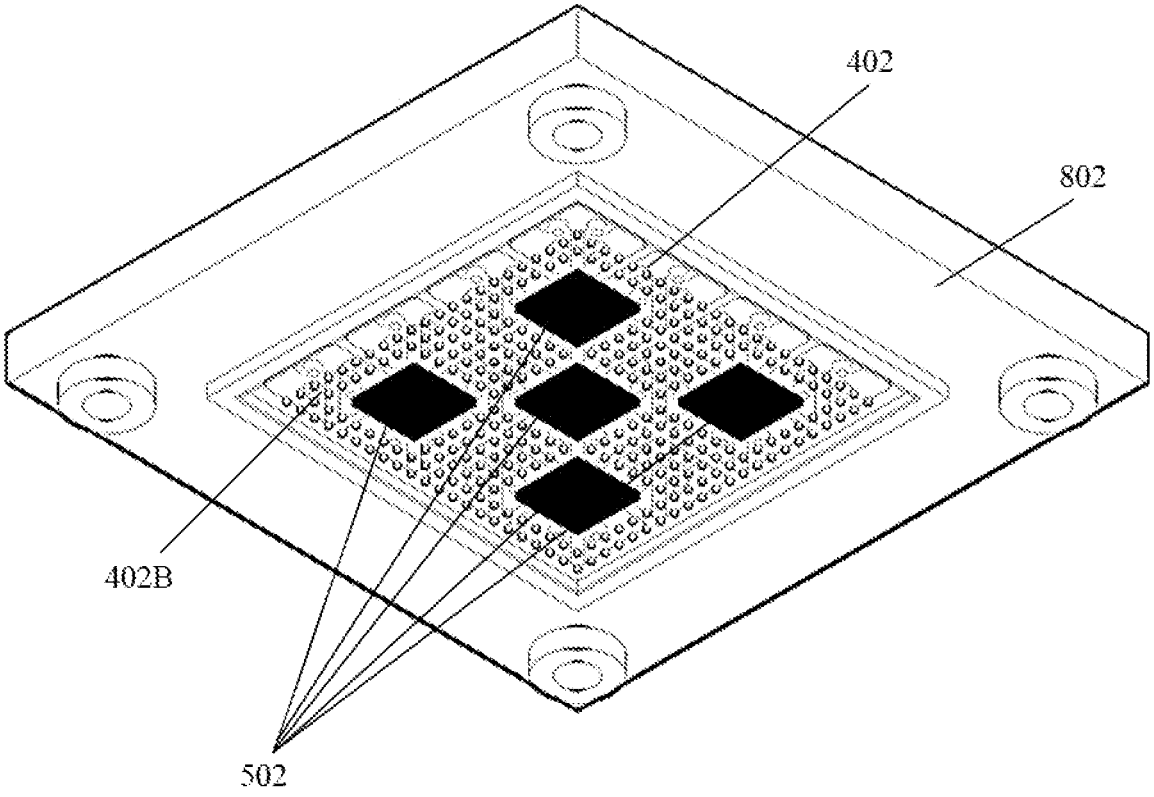
FIG. 8 illustrates a perspective bottom view of the exemplary waveguide antenna element based beam forming phased array antenna system of FIG. 1A integrated with a first substrate and a plurality of chips, and mounted on a board in an antenna system, in accordance with an exemplary embodiment of the disclosure.

FIG. 8 illustrates a perspective bottom view of the exemplary waveguide antenna element based beam forming phased array antenna system of FIG. 1A integrated with a first substrate and a plurality of chips and mounted on a board in an antenna system, in accordance with an exemplary embodiment of the disclosure. With reference to FIG. 8, there is shown the plurality of chips 502 connected to the lower side 402B of the first substrate 402. The plurality of chips 502 may be electrically connected with the plurality of pins (such as pins 512*a* to 512*h*) and the ground (ground 514*a* to 514*d*) of each of the plurality of radiating waveguide antenna cells 102. For example, in this case, each chip of the plurality of chips 502 may be connected to four radiating waveguide antenna cells of the plurality of radiating waveguide antenna cells 102, via a plurality of vertical routing connections and a plurality of horizontal routing connections. An example of the plurality of vertical routing connections 602 and the plurality of horizontal routing connections 604 for one radiating waveguide antenna cell (such as the radiating waveguide antenna cell 102A) has been shown and described in FIG. 6. The plurality of chips 502 may be configured to control beamforming through a second end (e.g., the open end 202 or the second end 516) of each radiating waveguide antenna cell of the plurality of radiating waveguide antenna cells 102 for the millimeter wave communication. The integrated assembly of the waveguide antenna element based beam forming phased array 100A with the first substrate 402 and the plurality of chips 502 may be mounted on a board 802 (e.g., an printed circuit board or an evaluation board) for quality control (QC) testing and to provide a modular arrangement that is easy-to-install.

Figure 9:
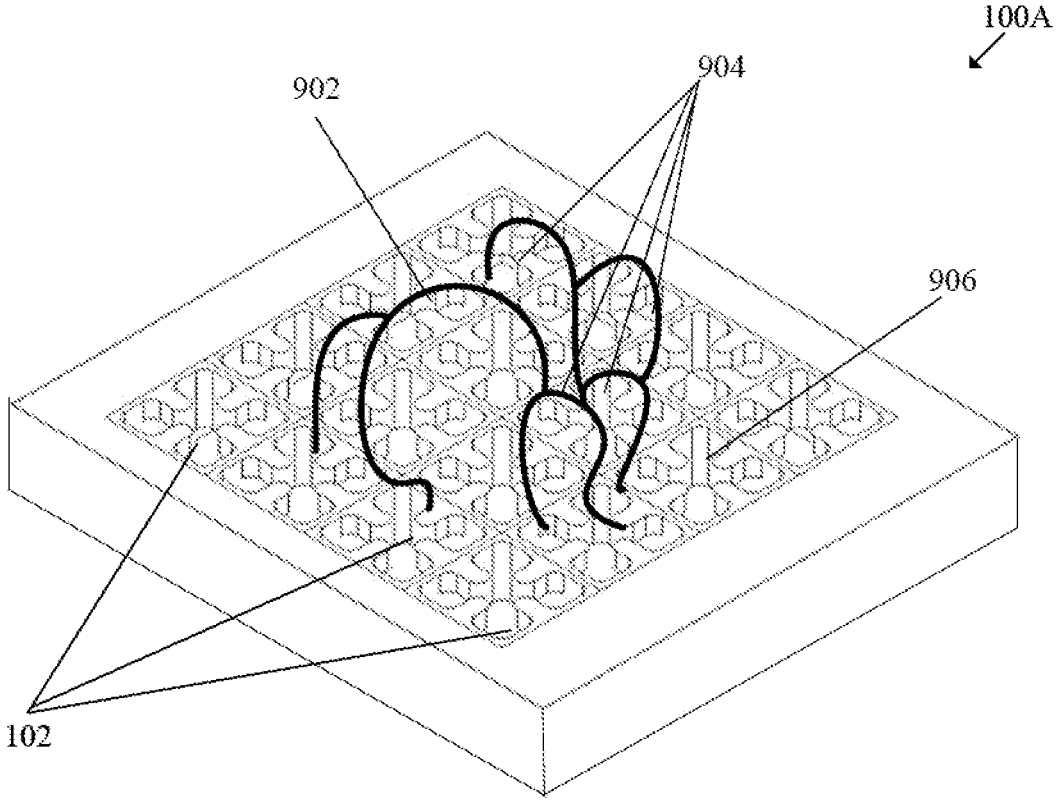
FIG. 9 illustrates beamforming on an open end of the exemplary waveguide antenna element based beam forming phased array antenna system of FIG. 1A in the first exemplary antenna system of FIG. 5, in accordance with an exemplary embodiment of the disclosure.

FIG. 9 illustrates beamforming on an open end of the exemplary waveguide antenna element based beam forming phased array antenna system of FIG. 1A in the first exemplary antenna system of FIG. 5A or 5B, in accordance with an exemplary embodiment of the disclosure. With reference to FIG. 9, there is show a main lobe 902 of a RF beam and a plurality of side lobes 904 radiating from an open end 906 of each radiating waveguide antenna cell of the plurality of radiating waveguide antenna cells 102 of the waveguide antenna element based beam forming phased array 100A. The plurality of chips 502 may be configured to control beamforming through the open end 906 of each radiating waveguide antenna cell of the plurality of radiating waveguide antenna cells 102 for the millimeter wave communication. The plurality of chips 502 may include a set of receiver (Rx) chips, a set of transmitter (Tx) chips, and a signal mixer chip. In some implementation, among the plurality of chips 502, two or more chips (e.g. chips 502*a*, 502*b*, 502*c*, and 502*d*) may be the set of Rx chips and the set of Tx chips, and at least one chip (e.g. the chip 502*e*) may be the signal mixer chip. In some embodiments, each of the set of Tx chips may comprise various circuits, such as a transmitter (Tx) radio frequency (RF) frontend, a digital to analog converter (DAC), a power amplifier (PA), and other miscellaneous components, such as filters (that reject unwanted spectral components) and mixers (that modulates a frequency carrier signal with an oscillator signal). In some embodiments, each of the set of Rx chips may comprise various circuits, such as a receiver (Rx) RF frontend, an analog to digital converter (ADC), a low noise amplifier (LNA), and other miscellaneous components, such as filters, mixers, and frequency generators. The plurality of chips 502 in conjunction with the waveguide antenna element based beam forming phased array 100A of the antenna system 500A or 500B may be configured to generate extremely high frequency (EHF), which is the band of radio frequencies in the electromagnetic spectrum from 30 to 300 gigahertz. Such radio frequencies have wavelengths from ten to one millimeter, referred to as millimeter wave (mmW).

In accordance with an embodiment, the plurality of chips 502 are configured to control propagation, a direction and angle (or tilt, such as 18, 22.5 or 45 degree tilt) of the RF beam (e.g. the main lobe 902 of the RF beam) in millimeter wave frequency through the open end 906 of the plurality of radiating waveguide antenna cells 102 for the millimeter wave communication between the antenna system 500A or 500B and a millimeter wave-based communication device. Example of the millimeter wave-based communication device may include, but are not limited to active reflectors, passive reflectors, or other millimeter wave capable telecommunications hardware, such as customer premises equipments (CPEs), smartphones, or other base stations. In this case, a 22.5 degree tilt of the RF beam is shown in FIG. 9 in an example. The antenna system 500A or 500B may be used as a part of communication device in a mobile network, such as a part of a base station or an active reflector to send and receive beam of RF signals for high throughput data communication in millimeter wave frequency (for example, broadband).

Figure 10:
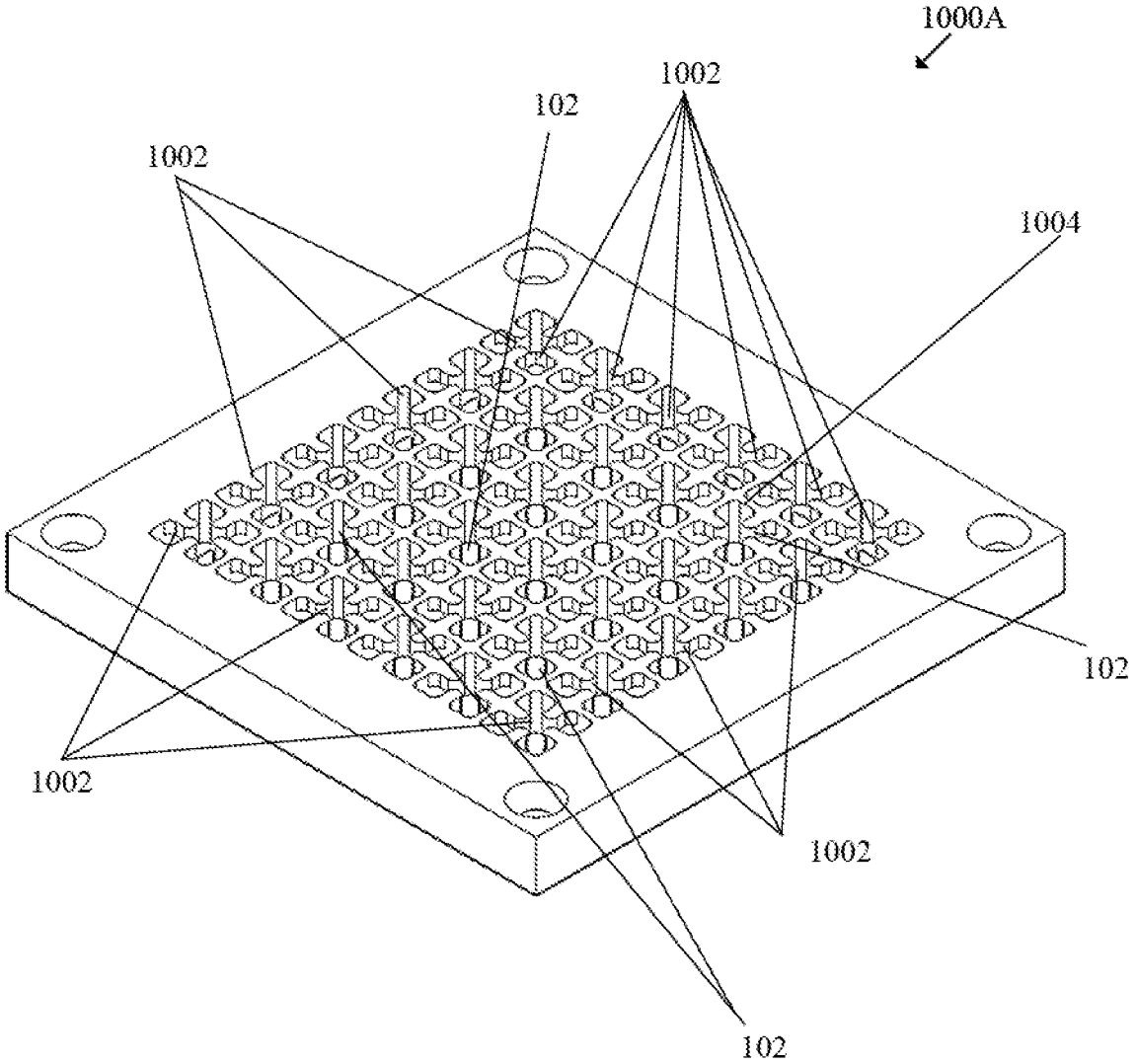
FIG. 10 depicts a perspective top view of an exemplary four-by-four waveguide antenna element based beam forming phased array antenna system with dummy elements, in accordance with an exemplary embodiment of the disclosure.

FIG. 10 depicts a perspective top view of an exemplary four-by-four waveguide antenna element based beam forming phased array antenna system with dummy elements, in accordance with an exemplary embodiment of the disclosure. With reference to FIG. 10, there is shown a waveguide antenna element based beam forming phased array 1000A. The waveguide antenna element based beam forming phased array 1000A is a one-piece structure that comprises a plurality of non-radiating dummy waveguide antenna cells 1002 arranged in a first layout 1004 in addition to the plurality of radiating waveguide antenna cells 102 (of FIG. 1A). The plurality of non-radiating dummy waveguide antenna cells 1002 are positioned at edge regions (including corners) surrounding the plurality of radiating waveguide antenna cells 102 in the first layout 1004, as shown. Such arrangement of the plurality of non-radiating dummy waveguide antenna cells 1002 at edge regions (including corners) surrounding the plurality of radiating waveguide antenna cells 102 is advantageous and enables even electromagnetic wave (or RF wave) radiation for the millimeter wave communication through the second end (such as the open end 906) of each of the plurality of radiating waveguide antenna cells 102 irrespective of positioning of the plurality of radiating waveguide antenna cells 102 in the first layout 1004. For example, radiating waveguide antenna cells that lie in the middle portion in the first layout 1004 may have same amount of radiation or achieve similar extent of tilt of a RF beam as compared to the radiating waveguide antenna cells that lie next to the plurality of non-radiating dummy waveguide antenna cells 1002 at edge regions (including corners).

Figure 11:
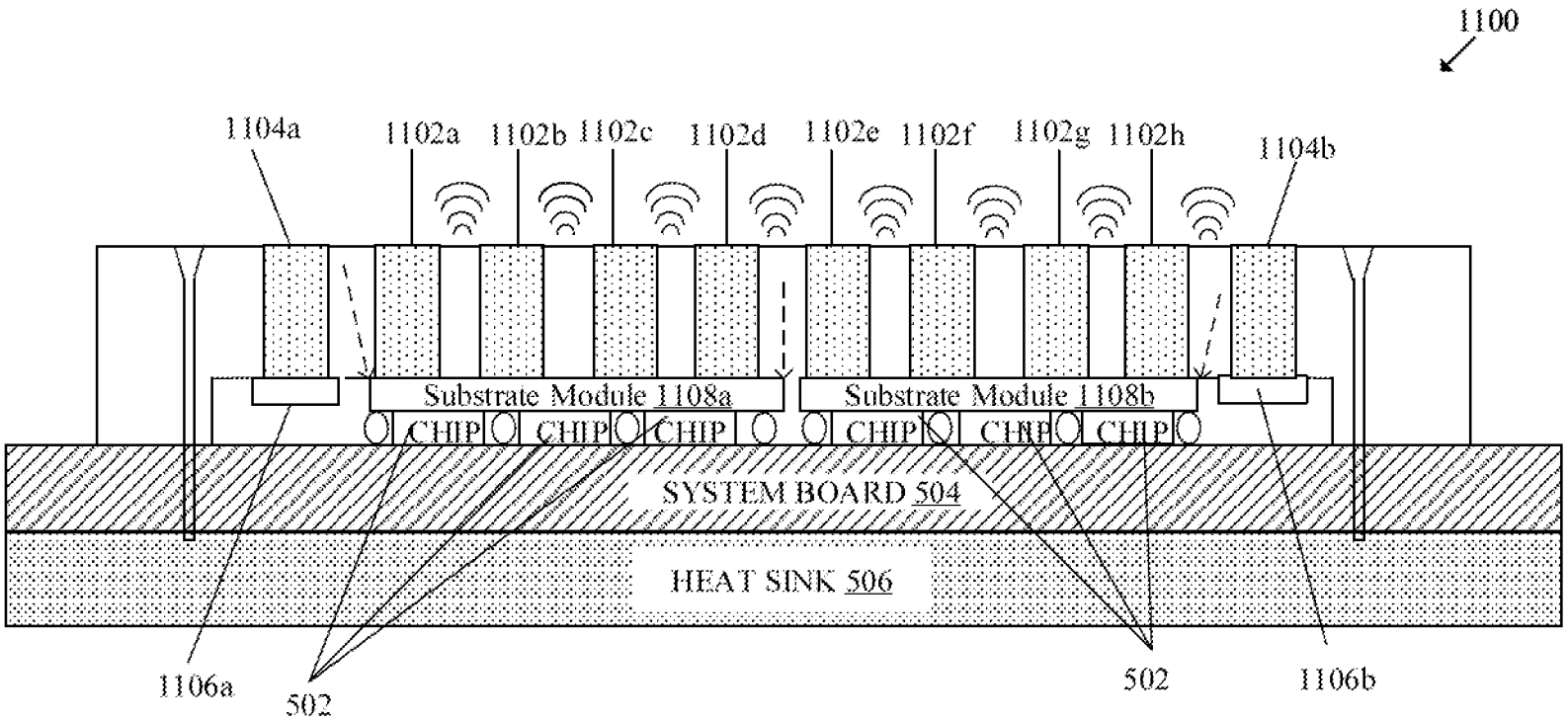
FIG. 11 illustrates various components of a third exemplary antenna system, in accordance with an exemplary embodiment of the disclosure.

FIG. 11 illustrates various components of a third exemplary antenna system, in accordance with an exemplary embodiment of the disclosure. With reference to FIG. 11, there is shown a cross-sectional side view of an antenna system 1100. The antenna system 1100 may comprise a plurality of radiating waveguide antenna cells (such as radiating waveguide antenna cells 1102*a* to 1102*h*) and a plurality of non-radiating dummy waveguide antenna cells (such as non-radiating dummy waveguide antenna cells 1104*a* and 1104*b*) in an waveguide antenna element based beam forming phased array. The waveguide antenna element based beam forming phased array may be an 8×8 (eight-by-eight) waveguide antenna element based beam forming phased array (shown in FIG. 12). In FIG. 11, a cross-sectional side view of the waveguide antenna element based beam forming phased array is shown in two dimension (2D).

The radiating waveguide antenna cells 1102*a* to 1102*d* may be mounted on a substrate module 1108*a*. The radiating waveguide antenna cells 1102*e* to 1102*h* may be mounted on a substrate module 1108*b*. The substrate modules 1108*a* and 1108*b* corresponds to the first substrate 402. The plurality of non-radiating dummy waveguide antenna cells (such as non-radiating dummy waveguide antenna cells 1104*a* and 1104*b*) are mounted on a second substrate (such as dummy substrates 1106*a* and 1106*b*). In some embodiments, the plurality of non-radiating dummy waveguide antenna cells may be mounted on the same type of substrate (such as the first substrate 402 or substrate modules 1108*a* and 1108*b*) as of the plurality of radiating waveguide antenna cells. In some embodiments, the plurality of non-radiating dummy waveguide antenna cells (such as non-radiating dummy waveguide antenna cells 1104*a* and 1104*b*) may be mounted on a different type of substrate, such as the dummy substrates 1106*a* and 1106*b*, which may be inexpensive as compared to first substrate the plurality of radiating waveguide antenna cells to reduce cost. The second substrate (such as dummy substrates 1106*a* and 1106*b*) may be different than the first substrate (such as the substrate modules 1108*a* and 1108*b*). This is a significant advantage compared to conventional approaches, where the conventional radiating antenna elements and the dummy antenna elements are on the same expensive substrate. The plurality of chips 502, the main system board 504, and the heat sink 506, are also shown, which are connected in a similar manner as described in FIG. 5.

Figure 12:
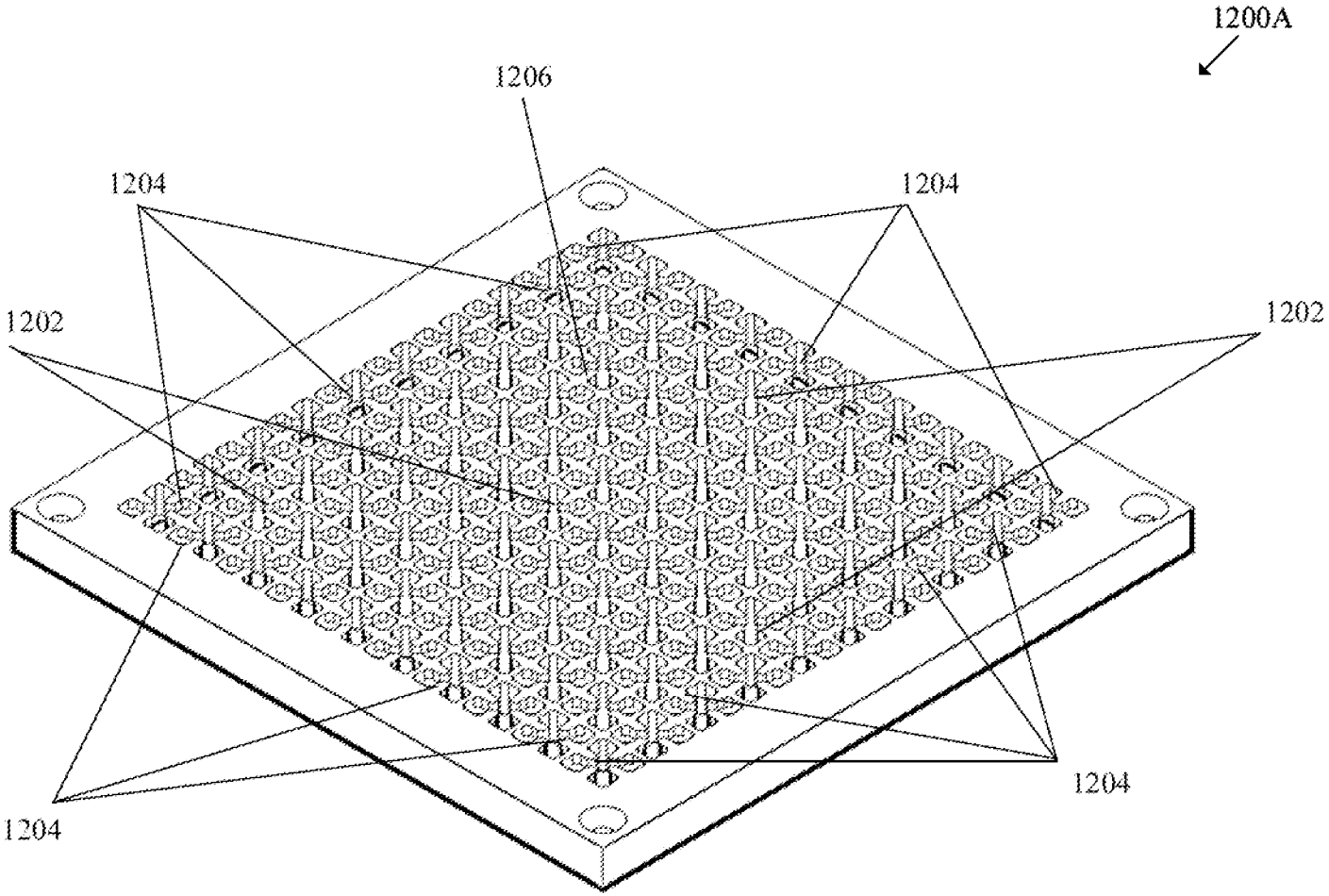
FIG. 12 depicts a perspective top view of an exemplary eight-by-eight waveguide antenna element based beam forming phased array antenna system with dummy elements, in accordance with an exemplary embodiment of the disclosure.

FIG. 12 depicts a perspective top view of an exemplary eight-by-eight waveguide antenna element based beam forming phased array antenna system with dummy elements, in accordance with an exemplary embodiment of the disclosure. With reference to FIG. 12, there is shown a waveguide antenna element based beam forming phased array 1200A. The waveguide antenna element based beam forming phased array 1200A is a one-piece structure that comprises a plurality of non-radiating dummy waveguide antenna cells 1204 (such as the non-radiating dummy waveguide antenna cells 1104*a* and 1104*b* of FIG. 11) in addition to a plurality of radiating waveguide antenna cells 1202 (such as the radiating waveguide antenna cells 1102*a* to 1102*h* of FIG. 11). The plurality of non-radiating dummy waveguide antenna cells 1204 are positioned at edge regions (including corners) surrounding the plurality of radiating waveguide antenna cells 1202, as shown. Such arrangement of the plurality of non-radiating dummy waveguide antenna cells 1204 at edge regions (including corners) surrounding the plurality of radiating waveguide antenna cells 1202 is advantageous and enables even electromagnetic wave (or RF wave) radiation for the millimeter wave communication through the second end (such as an open end 1206) of each of the plurality of radiating waveguide antenna cells 1202 irrespective of positioning of the plurality of radiating waveguide antenna cells 1202 in the waveguide antenna element based beam forming phased array 1200A.

Figure 13:
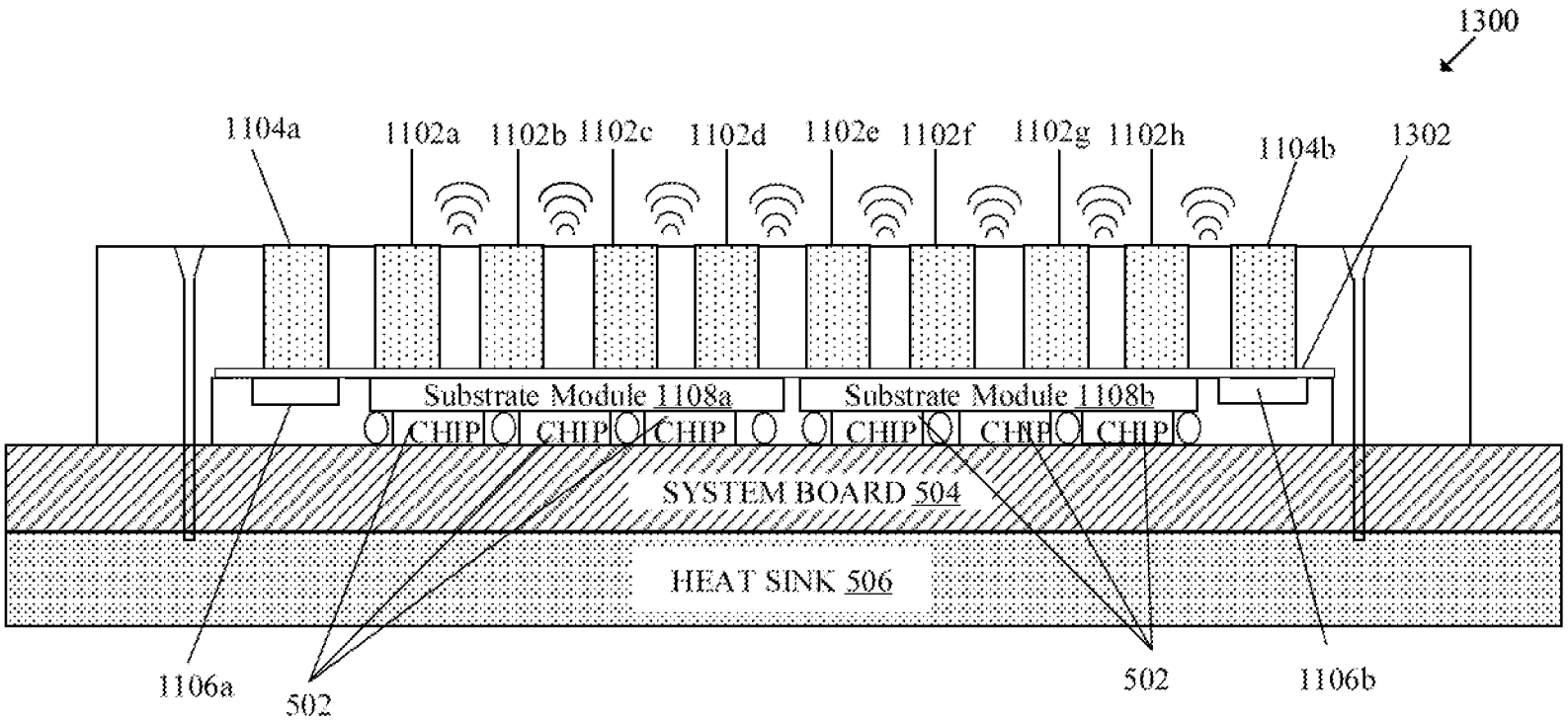
FIG. 13 illustrates various components of a fourth exemplary antenna system, in accordance with an exemplary embodiment of the disclosure.

FIG. 13 illustrates various components of a fourth exemplary antenna system, in accordance with an exemplary embodiment of the disclosure. FIG. 13 is described in conjunction with elements of FIG. 11. With reference to FIG. 13, there is shown a cross-sectional side view of an antenna system 1300. The antenna system 1300 may be similar to the antenna system 1100. The antenna system 1300 further includes an interposer 1302 in addition to the various components of the antenna system 1100 as described in FIG. 11. The interposer 1302 may be positioned only beneath the edge regions of a waveguide antenna element based beam forming phased array (such as the waveguide antenna element based beam forming phased array 100A or the waveguide antenna element based beam forming phased array 1200A at a first end (such as the first end 210) to shield radiation leakage from the first end of the plurality of radiating waveguide antenna cells (e.g., the plurality of radiating waveguide antenna cells 1202) of the waveguide antenna element based beam forming phased array (such as the waveguide antenna element based beam forming phased arrays 100A, 1000A, 1200A). In some embodiments, interposer 1302 may facilitate electrical connection routing from one waveguide antenna element based beam forming phased array to another waveguide antenna element based beam forming phased array at the edge regions. The interposer 1302 may not extend or cover the entire area of the waveguide antenna element based beam forming phased array at the first end (i.e., the end that is mounted on the first substrate (such as the substrate modules 1108*a* and 1108*b*). This may be further understood from FIGS. 14 and 15.

Figure 14:
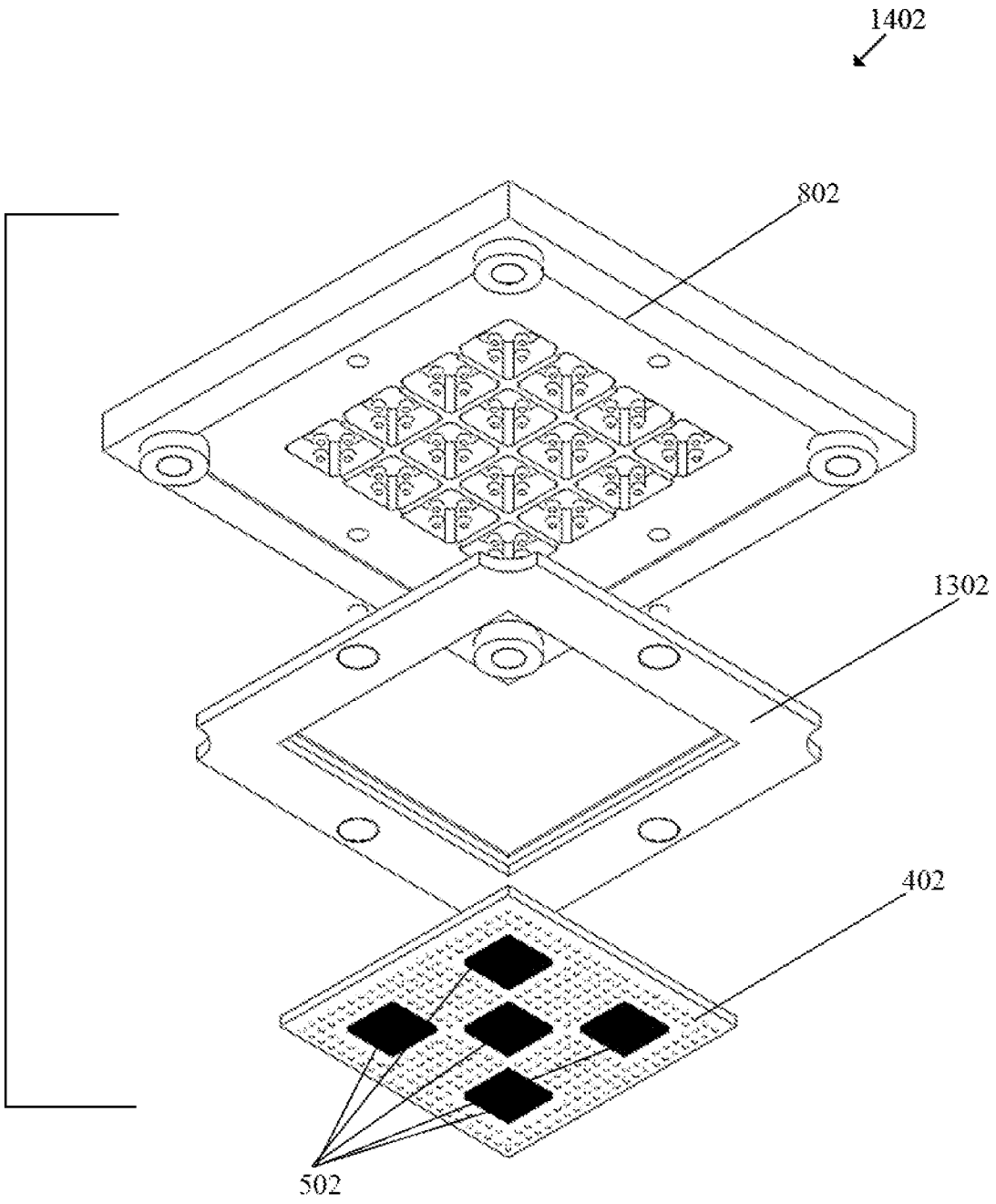
FIG. 14 illustrates positioning of an interposer in an exploded view of an exemplary four-by-four waveguide antenna element based beam forming phased array antenna system module, in accordance with an exemplary embodiment of the disclosure.

FIG. 14 illustrates positioning of an interposer in an exploded view of an exemplary four-by-four waveguide antenna element based beam forming phased array antenna system module, in accordance with an exemplary embodiment of the disclosure. With reference to FIG. 14, there is shown a four-by-four waveguide antenna element based beam forming phased array module 1402 with the interposer 1302. The four-by-four waveguide antenna element based beam forming phased array module 1402 may correspond to the integrated assembly of the waveguide antenna element based beam forming phased array 100A with the first substrate 402 and the plurality of chips 502 mounted on the board, as shown and described in FIG. 8. The interposer 1302 may have a square-shaped or a rectangular-shaped hollow frame-like structure (for example a socket frame) with perforations to removably attach to corresponding protruded points on the four-by-four waveguide antenna element based beam forming phased array module 1402, as shown in an example.

Figure 15:
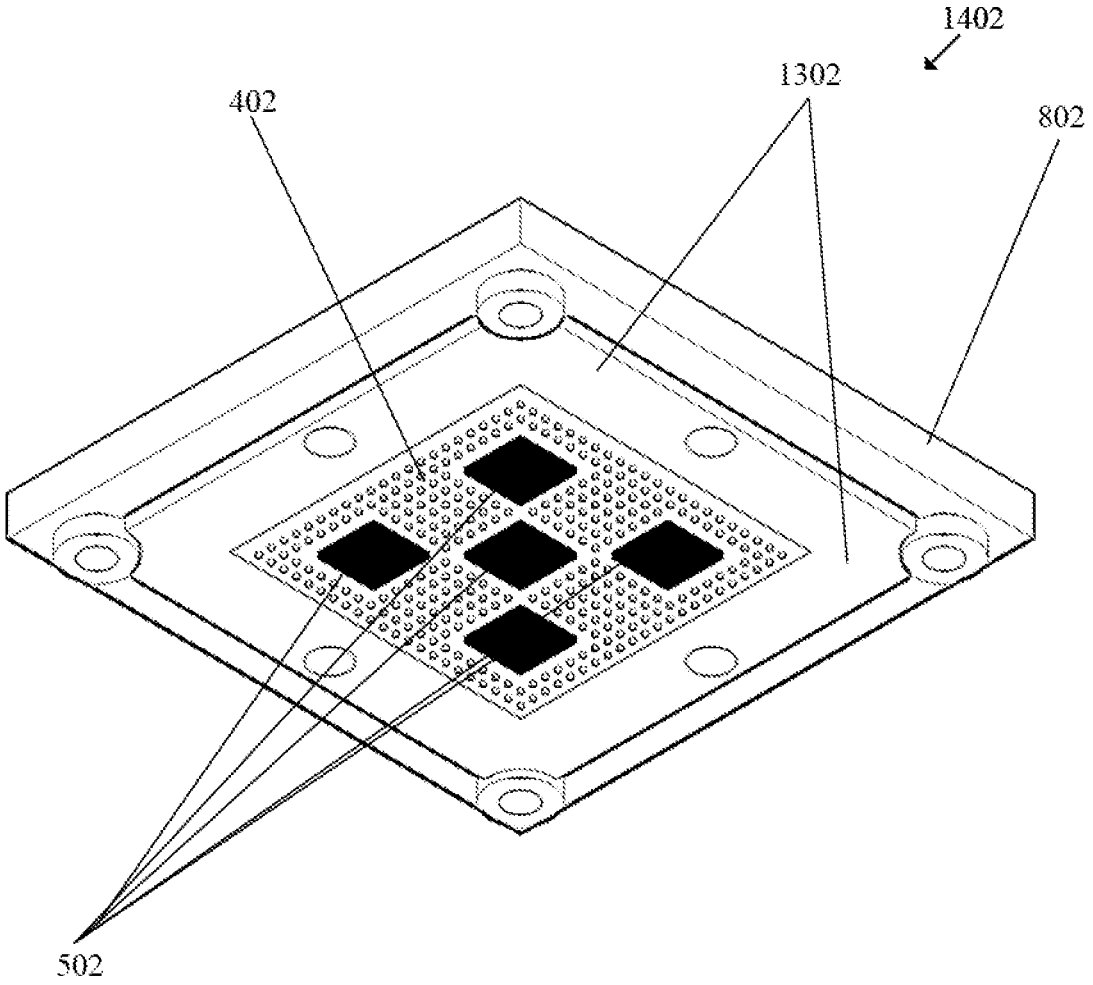
FIG. 15 illustrates the interposer of FIG. 14 in an affixed state in an exemplary four-by-four waveguide antenna element based beam forming phased array antenna system module, in accordance with an exemplary embodiment of the disclosure.

FIG. 15 illustrates the interposer of FIG. 14 in an affixed state in an exemplary four-by-four waveguide antenna element based beam forming phased array antenna system module, in accordance with an exemplary embodiment of the disclosure. With reference to FIG. 15, there is shown the interposer 1302*a* in an affixed state on the four-by-four waveguide antenna element based beam forming phased array module 1402. As shown, the interposer 1302 may be positioned only beneath the edge regions of a waveguide antenna element based beam forming phased array, such as the four-by-four waveguide antenna element based beam forming phased array module 1402 in this case.

Figure 16:
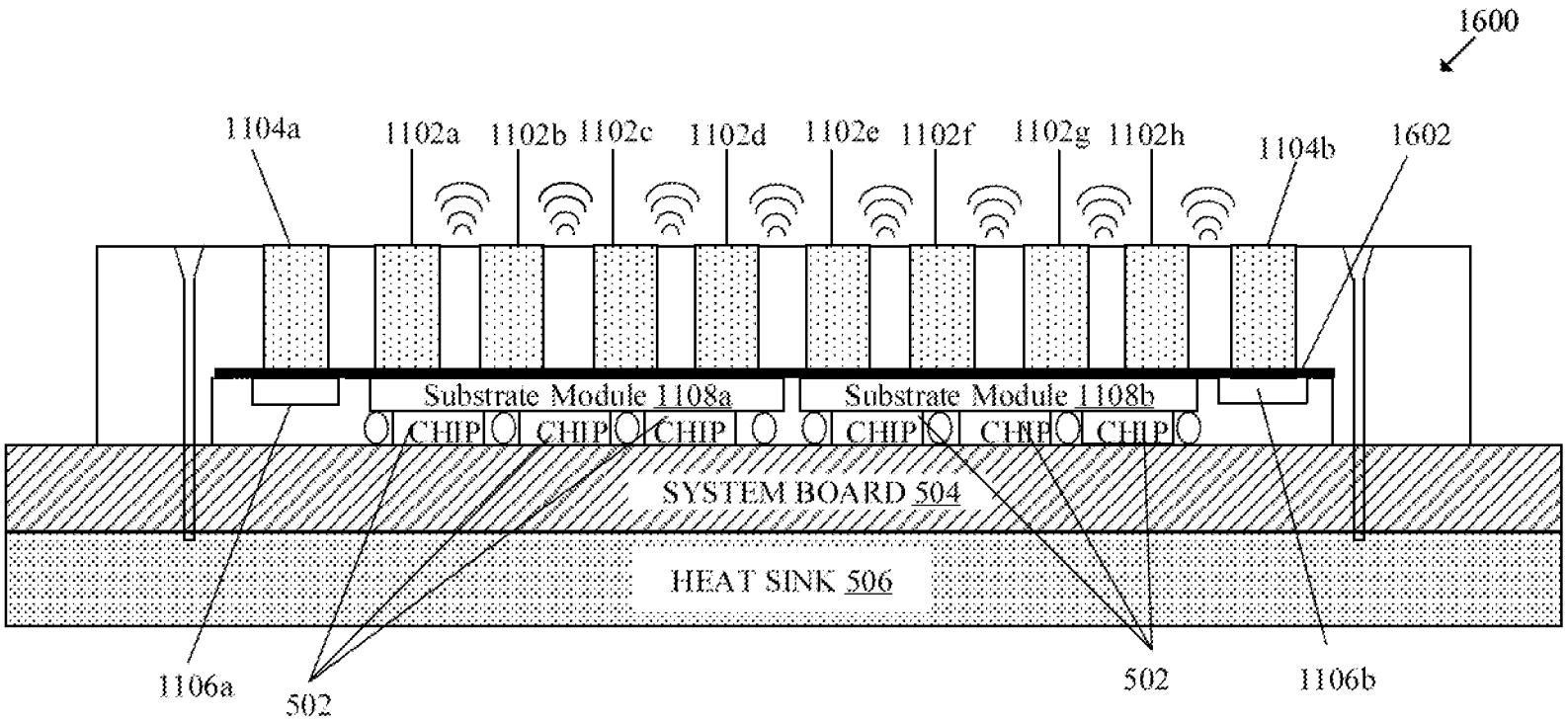
FIG. 16 illustrates various components of a fifth exemplary antenna system, in accordance with an exemplary embodiment of the disclosure.

FIG. 16 illustrates various components of a fifth exemplary antenna system, in accordance with an exemplary embodiment of the disclosure. FIG. 16 is described in conjunction with elements of FIGS. 1A, 1B, 2A, 2B, 3A, 3B, and 4 to 15. With reference to FIG. 16, there is shown a cross-sectional side view of an antenna system 1600. The antenna system 1600 may be similar to the antenna system 1100 of FIG. 11. The antenna system 1600 further includes a ground (gnd) layer 1602 in addition to the various components of the antenna system 1100 as described in FIG. 11. The gnd layer 1602 is provided between the first end (such as the first end 210) of the plurality of radiating waveguide antenna cells (such as the radiating waveguide antenna cells 1102*a* to 1102*d*) of a waveguide antenna element based beam forming phased array and the first substrate (such as the substrate modules 1108*a* and 1108*b* or the first substrate 402 (FIGS. 4A and 5) to avoid or minimize ground loop noise from the ground (such as the ground 1106) of each radiating waveguide antenna cell of the plurality of the radiating waveguide antenna cells of the waveguide antenna element based beam forming phased array (such as the waveguide antenna element based beam forming phased array 100A or 1200A).

In accordance with an embodiment, the antenna system (such as the antenna system 500A, 500B, 1100, and 1300), may comprise a first substrate (such as the first substrate 402 or the substrate modules 1108*a* and 1108*b*), a plurality of chips (such as the chip 404 or the plurality of chips 502); and a waveguide antenna element based beam forming phased array (such as the waveguide antenna element based beam forming phased array 100A, 1000A, or 1200A) having a unitary body that comprises a plurality of radiating waveguide antenna cells (such as the plurality of radiating waveguide antenna cells 102, 1002, 1202, or 510), in a first layout (such as the first layout 1004 for millimeter wave communication. Each radiating waveguide antenna cell comprises a plurality of pins (such as the plurality of pins 206) that are connected with a body (such as the ground 208) of a corresponding radiating waveguide antenna cell that acts as ground for the plurality of pins. A first end of the plurality of radiating waveguide antenna cells of the waveguide antenna element based beam forming phased array as the unitary body in the first layout is mounted on the first substrate. The plurality of chips may be electrically connected with the plurality of pins and the ground of each of the plurality of radiating waveguide antenna cells to control beamforming through a second end (such as the open end 202 or 906) of the plurality of radiating waveguide antenna cells for the millimeter wave communication.

Figure 17:
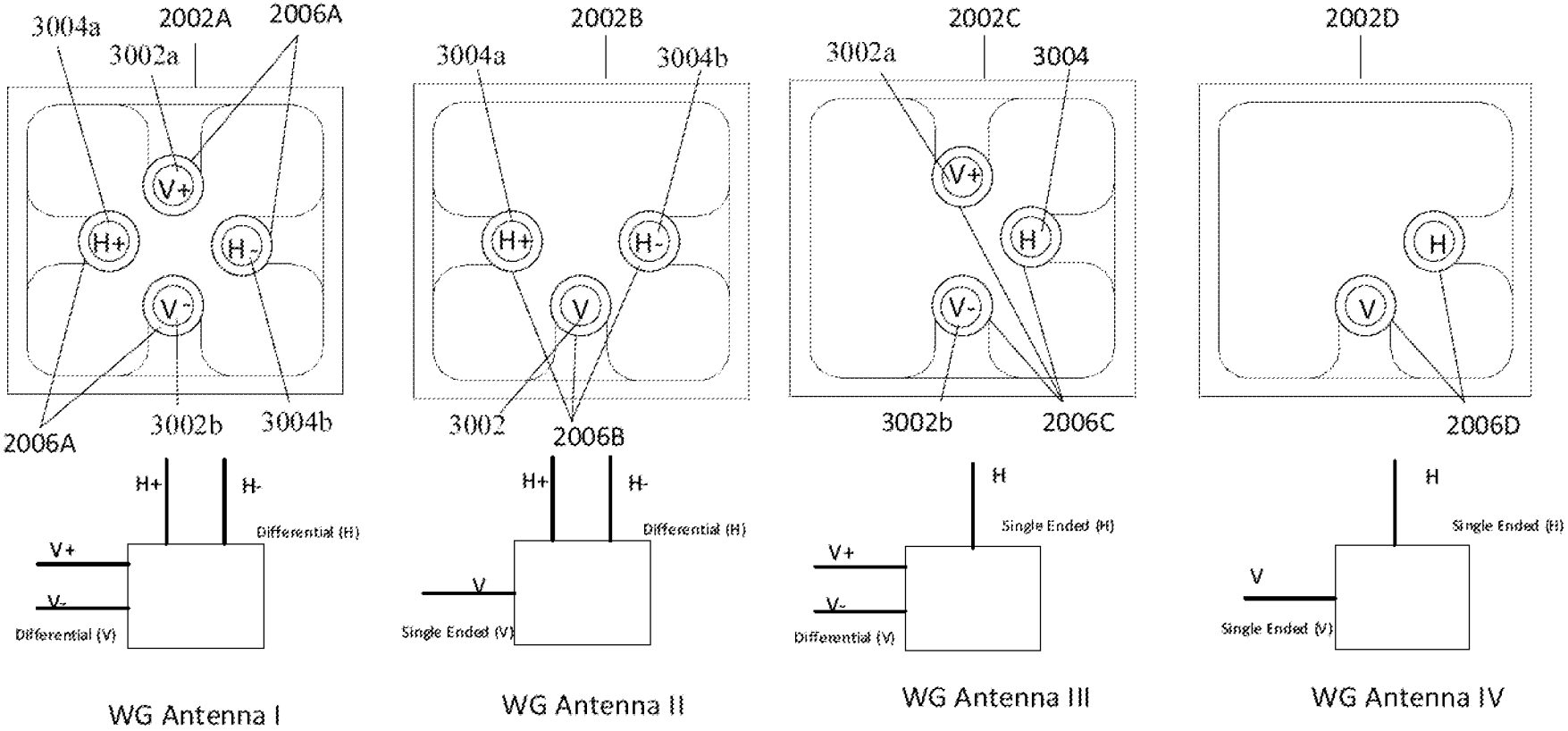
FIG. 17 depicts schematic bottom views of a plurality of versions of the exemplary radiating waveguide antenna cell of the exemplary waveguide antenna element based beam forming phased array antenna system for millimeter wave communication of FIG. 1A, in accordance with an exemplary embodiment of the disclosure.

FIG. 17 depicts schematic bottom views of different versions of the exemplary radiating waveguide antenna cell of the exemplary waveguide antenna element based beam forming phased array antenna system for millimeter wave communication of FIG. 1A, in accordance with an exemplary embodiment of the disclosure. With reference to FIG. 17, there are shown schematic bottom views of different versions of the radiating waveguide antenna cell 102A of FIG. 2B. There are shown four different variations of the radiating waveguide antenna cell 102A. In accordance with an embodiment, the plurality of pins 2006A in a first version of the radiating waveguide antenna cell 2002A includes a pair of vertical polarization pins 3002*a* and 3002*b* that acts as the first positive terminal and the first negative terminal. The plurality of pins 2006A in the radiating waveguide antenna cell 2002A further includes a pair of horizontal polarization pins 3004*a* and 3004*b* that acts as the second positive terminal and the second negative terminal. The pair of vertical polarization pins 3002*a* and 3002*b* and the pair of horizontal polarization pins 3004*a* and 3004*b* are utilized for dual-polarization. Thus, the waveguide antenna element based beam forming phased array 100A may be a dual-polarized open waveguide array antenna configured to transmit and receive radio frequency (RF) waves for the millimeter wave communication in both horizontal and vertical polarizations. In accordance with an embodiment, the plurality of pins 2006B in a second version of the radiating waveguide antenna cell 2002B includes a vertical polarization pin 3002 that acts as a single-ended polarization pin. The plurality of pins 2006B in the radiating waveguide antenna cell 2002B further includes a pair of horizontal polarization pins 3004*a* and 3004*b* that acts as the positive terminal and the negative terminal. The pair of horizontal polarization pins 3004*a* and 3004*b* are utilized for dual-polarization and the vertical polarization pin 3002 may be utilized for single-ended antennas. Thus, the waveguide antenna element based beam forming phased array 100A may be a dual-polarized open waveguide array antenna configured to transmit and receive radio frequency (RF) waves for the millimeter wave communication in horizontal polarization and integrated to single-ended antennas for vertical polarization. In accordance with an embodiment, the plurality of pins 2006C in a third version of the radiating waveguide antenna cell 2002C includes a horizontal polarization pin 3004 that acts as the single-ended polarization pin. The plurality of pins 2006C in the radiating waveguide antenna cell 2002C further includes a pair of vertical polarization pins 3002*a* and 3002*b* that acts as the positive terminal and the negative terminal. The pair of vertical polarization pins 3002*a* and 3002*b* are utilized for dual-polarization and the horizontal polarization pin 3004 may be utilized for single-ended antennas. Thus, the waveguide antenna element based beam forming phased array 100A may be a dual-polarized open waveguide array antenna configured to transmit and receive radio frequency (RF) waves for the millimeter wave communication in vertical polarization and integrated to single-ended antennas for horizontal polarization. In accordance with an embodiment, the plurality of pins 2006D in a fourth version of the radiating waveguide antenna cell 2002D includes a vertical polarization pin 3002 and a horizontal polarization pin 3004. The vertical polarization pin 3002 and the horizontal polarization pin 3004 act as single-ended polarization pins and are utilized for single-ended antennas. Thus, the waveguide antenna element based beam forming phased array 100A may be integrated to single-ended antennas for vertical polarization and horizontal polarization.

Figure 18A:
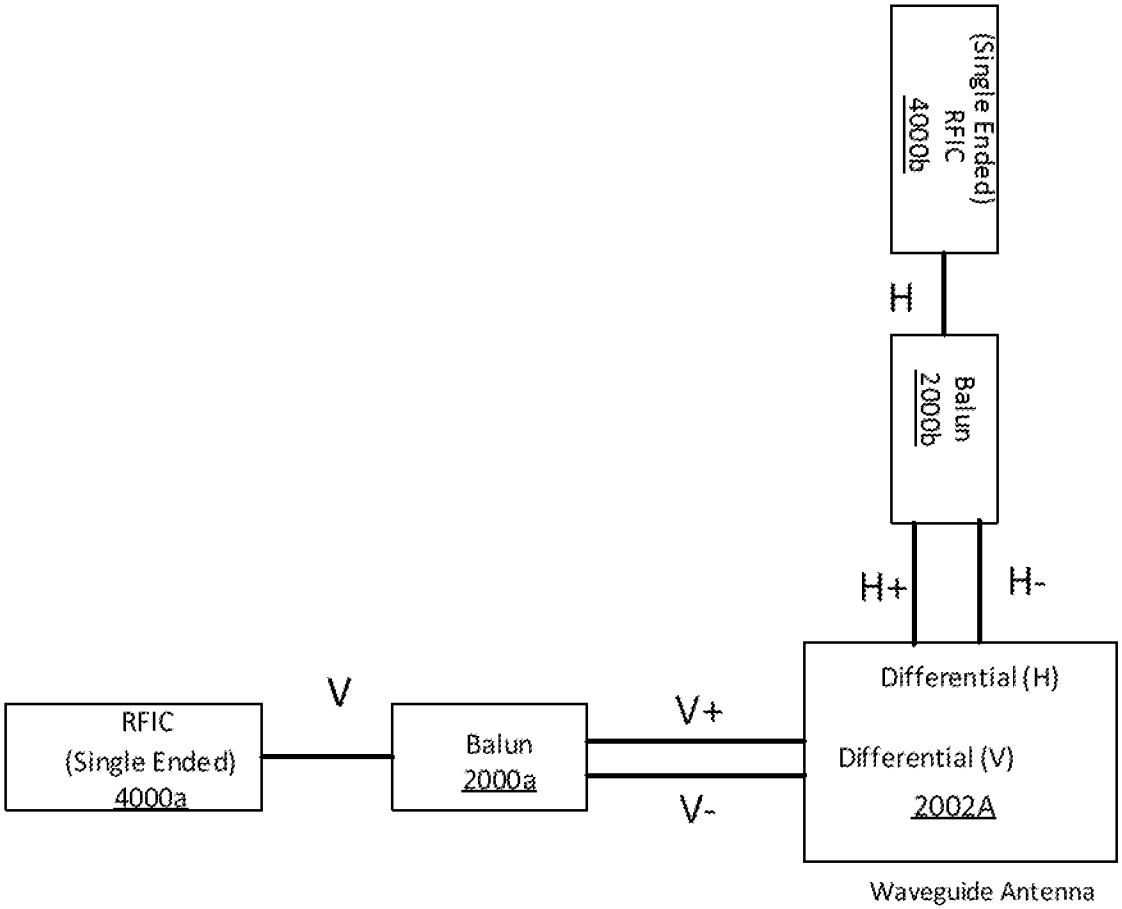
FIG. 18A depicts a first exemplary integration of various components to single-ended chips, in accordance with an exemplary embodiment of the disclosure.

FIG. 18A depicts a first exemplary integration of various components to single-ended chips, in accordance with an exemplary embodiment of the disclosure. FIG. 18A is described in conjunction with elements of FIGS. 1A, 1B, 2A, 2B, 3A, 3B, and 4 to 17. With reference to FIG. 18A, there is shown an integration of various components of an antenna system to single-ended chips. The radiating waveguide antenna cell 2002A as described in FIG. 17 may be the dual-polarized open waveguide array antenna in both horizontal polarizations and vertical polarizations. Accordingly, an electrical transformer such as, a Balun may be provided between a single-ended Radio-Frequency Integrated Circuit (RFIC) and the radiating waveguide antenna cell 2002A of a waveguide antenna element based beam forming phased array to transform a differential output of the radiating waveguide antenna cell 2002A to a single-ended input for the single-ended RFIC. In accordance with an embodiment, balun 2000*a* may be provided between the single-ended RFIC 4000*a* and the radiating waveguide antenna cell 2002A of a waveguide antenna element based beam forming phased array to transform the differential output of the radiating waveguide antenna cell 2002A in vertical polarization to the single-ended input for the single-ended RFIC 4000*a*. The balun 2000*b* may be provided between the single-ended RFIC 4000*b* and the radiating waveguide antenna cell 2002A of a waveguide antenna element based beam forming phased array to transform the differential output of the radiating waveguide antenna cell 2002A in horizontal polarization to the single-ended input for the single-ended RFIC 4000*b*.

Figure 18B:
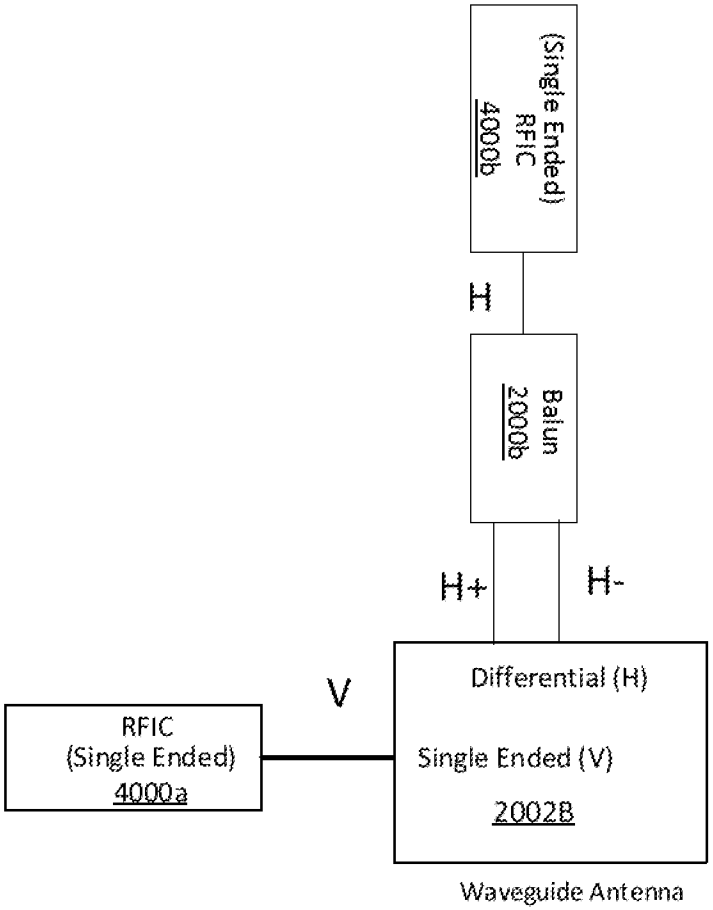
FIG. 18B depicts a second exemplary integration of various components to single-ended chips, in accordance with an exemplary embodiment of the disclosure.

FIG. 18B depicts a second exemplary integration of various components to single-ended chips, in accordance with an exemplary embodiment of the disclosure. FIG. 18B is described in conjunction with elements of FIGS. 1A, 1B, 2A, 2B, 3A, 3B, and 4 to 17. With reference to FIG. 18B, there is shown an integration of various components of an antenna system to single-ended chips. The radiating waveguide antenna cell 2002B as described in FIG. 17 may be the dual-polarized open waveguide array antenna in horizontal polarization and single-ended for vertical polarization. Accordingly, balun 2000*b* may be provided between the single-ended RFIC 4000*b* and the radiating waveguide antenna cell 2002B of a waveguide antenna element based beam forming phased array to transform the differential output of the radiating waveguide antenna cell 2002B in horizontal polarization to the single-ended input for the single-ended RFIC 4000*b*. In accordance with an embodiment, the single-ended RFIC 4000*a* may be configured to integrate with the radiating waveguide antenna cell 2002B for vertical polarization.

Figure 18C:
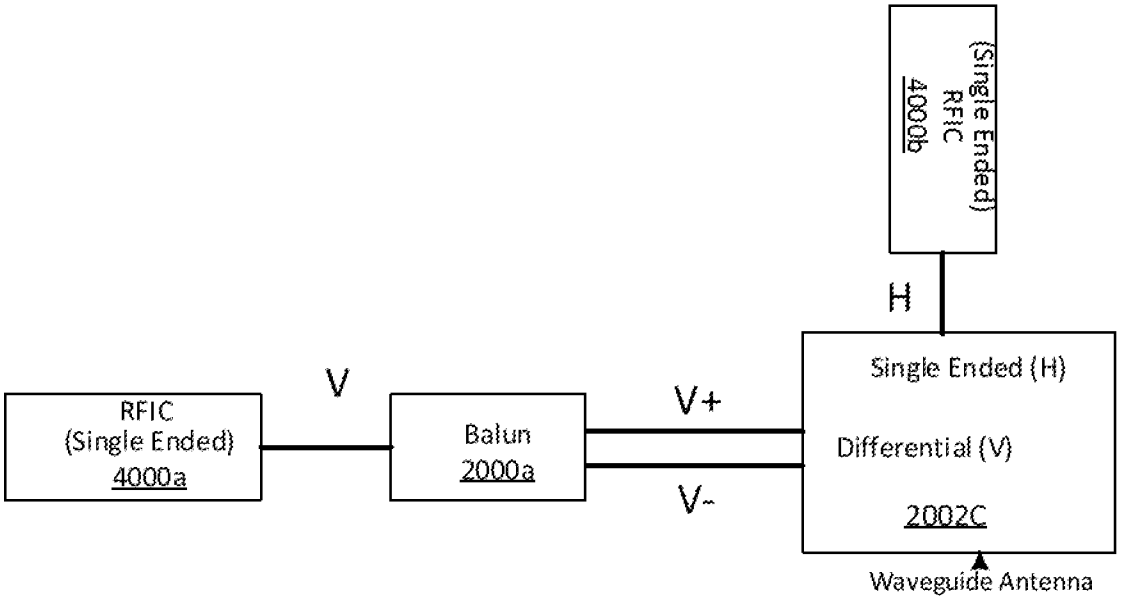
FIG. 18C depicts a third exemplary integration of various components to single-ended chips, in accordance with an exemplary embodiment of the disclosure.

FIG. 18C depicts a third exemplary integration of various components to single-ended chips, in accordance with an exemplary embodiment of the disclosure. FIG. 18C is described in conjunction with elements of FIGS. 1A, 1B, 2A, 2B, 3A, 3B, and 4 to 17. With reference to FIG. 18C, there is shown an integration of various components of an antenna system to single-ended chips. The radiating waveguide antenna cell 2002C as described in FIG. 17 may be the dual-polarized open waveguide array antenna in vertical polarization and integrated to single-ended antennas for horizontal polarization. Accordingly, balun 2000*a* may be provided between the single-ended RFIC 4000*a* and the radiating waveguide antenna cell 2002C of a waveguide antenna element based beam forming phased array to transform the differential output of the radiating waveguide antenna cell 2002C in vertical polarization to the single-ended input for the single-ended RFIC 4000*a*. In accordance with an embodiment, the single-ended RFIC 4000*b* may be configured to integrate with the radiating waveguide antenna cell 2002C for horizontal polarization.

Figure 18D:
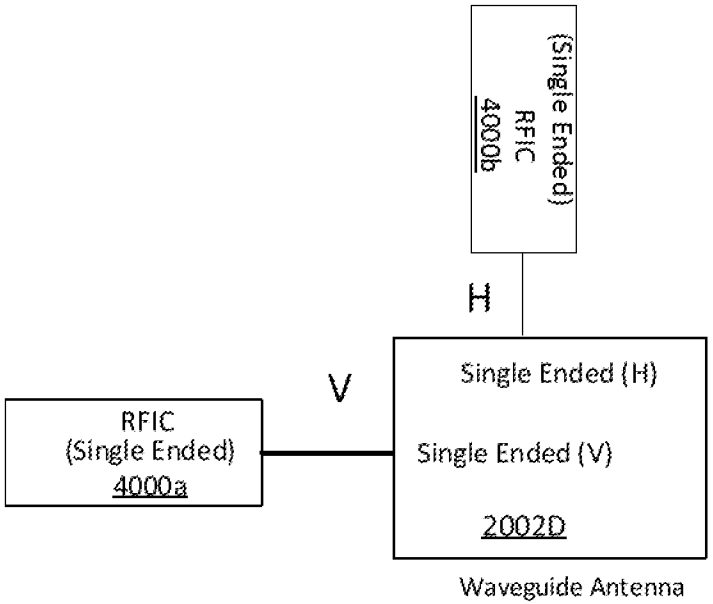
FIG. 18D depicts a fourth exemplary integration of various components to single-ended chips, in accordance with an exemplary embodiment of the disclosure.

FIG. 18D depicts a fourth exemplary integration of various components to single-ended chips, in accordance with an exemplary embodiment of the disclosure. FIG. 18D is described in conjunction with elements of FIGS. 1A, 1B, 2A, 2B, 3A, 3B, and 4 to 17. With reference to FIG. 18D, there is shown an integration of various components of an antenna system to single-ended chips. The radiating waveguide antenna cell 2002D as described in FIG. 17 may be single-ended antennas for vertical polarization and horizontal polarization. Accordingly, the single-ended RFIC 4000*a* may be configured to integrate with the radiating waveguide antenna cell 2002D for vertical polarization and the single-ended RFIC 4000*b* may be configured to integrate with the radiating waveguide antenna cell 2002D for horizontal polarization.

In accordance with an embodiment, the single-ended RFIC 4000*a* and the single-ended RFIC 4000*b* are separate chips. In accordance with an embodiment, the single-ended RFIC 4000*a* and the single-ended RFIC 4000*b* are two different terminals of a single chip.

In accordance with an embodiment, the waveguide antenna element based beam forming phased array may be a one-piece structure of four-by-four waveguide array comprising sixteen radiating waveguide antenna cells in the first layout, where the one-piece structure of four-by-four waveguide array corresponds to the unitary body of the waveguide antenna element based beam forming phased array. The waveguide antenna element based beam forming phased array may be one-piece structure of eight-by-eight waveguide array comprising sixty four radiating waveguide antenna cells in the first layout, where the one-piece structure of eight-by-eight waveguide array corresponds to the unitary body of the waveguide antenna element based beam forming phased array.

In accordance with an embodiment, the waveguide antenna element based beam forming phased array may be one-piece structure of N-by-N waveguide array comprising M number of radiating waveguide antenna cells in the first layout, wherein N is a positive integer and M is N to the power of 2. In accordance with an embodiment, the waveguide antenna element based beam forming phased array may further comprise a plurality of non-radiating dummy waveguide antenna cells (such as the plurality of non-radiating dummy waveguide antenna cells 1002 or 204 or the non-radiating dummy waveguide antenna cells 1104*a* and 1104*b*) in the first layout. The plurality of non-radiating dummy waveguide antenna cells may be positioned at edge regions surrounding the plurality of radiating waveguide antenna cells in the first layout to enable even radiation for the millimeter wave communication through the second end of each of the plurality of radiating waveguide antenna cells irrespective of positioning of the plurality of radiating waveguide antenna cells in the first layout.

In accordance with an embodiment, the antenna system may further comprise a second substrate (such as dummy substrates 1106*a* and 1106*b*). The plurality of non-radiating dummy waveguide antenna cells in the first layout are mounted on the second substrate that is different than the first substrate.

In accordance with an embodiment, the antenna system may further comprise a system board (such as the system board 504) having an upper surface and a lower surface. The upper surface of the system board comprises a plurality of electrically conductive connection points (such as the plurality of electrically conductive connection points 518) to connect to the ground of each of the plurality of radiating waveguide antenna cells of the waveguide antenna element based beam forming phased array using electrically conductive wiring connections that passes through the first substrate, where the first substrate is positioned between the waveguide antenna element based beam forming phased array and the system board.

In accordance with an embodiment, the antenna system may further comprise a heat sink (such as the heat sink 506) that is attached to the lower surface of the system board. The heat sink have a comb-like structure in which a plurality of protrusions of the heat sink passes through a plurality of perforations in the system board such that the plurality of chips are in contact to the plurality of protrusions of the heat sink to dissipate heat from the plurality of chips through the heat sink. The first substrate may comprise an upper side and a lower side, where the first end of the plurality of radiating waveguide antenna cells of the waveguide antenna element based beam forming phased array may be mounted on the upper side of the first substrate, and the plurality of chips are positioned between the lower side of the first substrate and the upper surface of the system board.

In accordance with an embodiment, the first substrate may comprises an upper side and a lower side, where the plurality of chips and the plurality of radiating waveguide antenna cells of the waveguide antenna element based beam forming phased array are positioned on the upper side of the first substrate. A vertical length between the plurality of chips and the first end of the plurality of radiating waveguide antenna cells of the waveguide antenna element based beam forming phased array may be less than a defined threshold to reduce insertion or routing loss between the plurality of radiating waveguide antenna cells of the waveguide antenna element based beam forming phased array and the plurality of chips, based on the positioning of the plurality of radiating waveguide antenna cells of the waveguide antenna element based beam forming phased array and the plurality of chips on a same side of the first substrate.

In accordance with an embodiment, the unitary body of the waveguide antenna element based beam forming phased array may have a metallic electrically conductive surface that acts as a heat sink to dissipate heat from the plurality of chips to atmospheric air through the metallic electrically conductive surface of the waveguide antenna element based beam forming phased array, based on a contact of the plurality of chips with the plurality of radiating waveguide antenna cells of the waveguide antenna element based beam forming phased array on the upper side of the first substrate. The plurality of pins in each radiating waveguide antenna cell may be protrude pins (such as the plurality of protrude pins 702) that protrude from the first end from a level of the body of the corresponding radiating waveguide antenna cell to establish a firm contact with the first substrate.

In accordance with an embodiment, the waveguide antenna element based beam forming phased array is a dual-polarized open waveguide array antenna configured to transmit and receive radio frequency waves for the millimeter wave communication in both horizontal and vertical polarizations or as left hand circular polarization (LHCP) or right hand circular polarization (RHCP). The plurality of pins in each radiating waveguide antenna cell may include a pair of vertical polarization pins that acts as a first positive terminal and a first negative terminal and a pair of horizontal polarization pins that acts as a second positive terminal and a second negative terminal, wherein the pair of vertical polarization pins and the pair of horizontal polarization pins are utilized for dual-polarization. The plurality of chips comprises a set of receiver (Rx) chips, a set of transmitter (Tx) chips, and a signal mixer chip.

In accordance with an embodiment, the plurality of chips may be configured to control propagation and a direction of a radio frequency (RF) beam in millimeter wave frequency through the second end of the plurality of radiating waveguide antenna cells for the millimeter wave communication between the antenna system and a millimeter wave-based communication device, where the second end may be an open end of the plurality of radiating waveguide antenna cells for the millimeter wave communication. The propagation of the radio frequency (RF) beam in millimeter wave frequency may be controlled based on at least a flow of current in each radiating waveguide antenna cell, where the current flows from the ground towards a negative terminal of a first chip of the plurality of chips via at least a first pin of the plurality of pins, and from a positive terminal of the first chip towards the ground via at least a second pin of the plurality of pins in each corresponding radiating waveguide antenna cell of the plurality of radiating waveguide antenna cells.

In accordance with an embodiment, the antenna system may further comprise an interposer (such as the interposer 1302) beneath the edge regions of the waveguide antenna element based beam forming phased array at the first end in the first layout to shield radiation leakage from the first end of the plurality of radiating waveguide antenna cells of the waveguide antenna element based beam forming phased array. In accordance with an embodiment, the antenna system may further comprise a ground (gnd) layer (such as the gnd layer 1602) between the first end of the plurality of radiating waveguide antenna cells of the waveguide antenna element based beam forming phased array and the first substrate to avoid or minimize ground loop noise from the ground of each radiating waveguide antenna cell of the plurality of the radiating waveguide antenna cells of the waveguide antenna element based beam forming phased array.

The waveguide antenna element based beam forming phased arrays 100A, 110A, 1000A, 1200A may be utilized in, for example, active and passive reflector devices disclosed in, for example, U.S. application Ser. No. 15/607,743, and U.S. application Ser. No. 15/834,894.

While various embodiments described in the present disclosure have been described above, it should be understood that they have been presented by way of example, and not limitation. It is to be understood that various changes in form and detail can be made therein without departing from the scope of the present disclosure. In addition to using circuitry or hardware (e.g., within or coupled to a central processing unit ("CPU"), microprocessor, micro controller, digital signal processor, processor core, system on chip ("SOC") or any other device), implementations may also be embodied in software (e.g. computer readable code, program code, and/or instructions disposed in any form, such as source, object or machine language) disposed for example in a non-transitory computer-readable medium configured to store the software. Such software can enable, for example, the function, fabrication, modeling, simulation, description and/or testing of the apparatus and methods describe herein. For example, this can be accomplished through the use of general program languages (e.g., C, C++), hardware description languages (HDL) including Verilog HDL, VHDL, and so on, or other available programs. Such software can be disposed in any known non-transitory computer-readable medium, such as semiconductor, magnetic disc, or optical disc (e.g., CD-ROM, DVD-ROM, etc.). The software can also be disposed as computer data embodied in a non-transitory computer-readable transmission medium (e.g., solid state memory any other non-transitory medium including digital, optical, analogue-based medium, such as removable storage media). Embodiments of the present disclosure may include methods of providing the apparatus described herein by providing software describing the apparatus and subsequently transmitting the software as a computer data signal over a communication network including the internet and intranets.

It is to be further understood that the system described herein may be included in a semiconductor intellectual property core, such as a microprocessor core (e.g., embodied in HDL) and transformed to hardware in the production of integrated circuits. Additionally, the system described herein may be embodied as a combination of hardware and software. Thus, the present disclosure should not be limited by any of the above-described exemplary embodiments, but should be defined only in accordance with the following claims and their equivalents.

What is claimed is:

1. An antenna system, comprising:

a first substrate;

a plurality of chips; and a waveguide antenna element based beam forming phased array that comprises a plurality of radiating waveguide antenna cells for millimeter wave communication, wherein each radiating waveguide antenna cell of the plurality of radiating waveguide antenna cells comprises a plurality of pins, wherein a first pin of the plurality of pins is connected with a body of a corresponding radiating waveguide antenna cell, wherein the body corresponds to ground for the plurality of pins, wherein a current flows from the ground towards a negative terminal of a first chip of the plurality of chips via the first pin of the plurality of pins, wherein a first end of the plurality of radiating waveguide antenna cells of the waveguide antenna element based beam forming phased array is mounted on the first substrate, and wherein the plurality of chips are electrically connected with the plurality of pins.

2. The antenna system according to claim 1, wherein each radiating waveguide antenna cell is configured to resonate at a first frequency range from 26.5 GigaHertz (GHz) to 29.5 GHz and a second frequency range from 37 GHz to 40.5 GHz.

3. The antenna system according to claim 2, wherein a first current path of the plurality of pins is configured to generate a first RF current and a second current path of the plurality of pins is configured to generate a second RF current, and wherein the first RF current resonates at the first frequency range and the second RF current resonates at the second frequency range.

4. The antenna system according to claim 1, wherein the plurality of chips is configured to:

generate a high band Radio Frequency (RF) signal and a low band RF signal at a transmitter, and generate the high band Radio Frequency (RF) signal and the low band RF signal at a receiver.

5. The antenna system according to claim 1, wherein a first direction of a first current path of the plurality of pins is same as a second direction of a second current path of the plurality of pins.

6. The antenna system according to claim 1, wherein distance between two consecutive radiating waveguide antenna cells of the plurality of radiating waveguide antenna cells is based on a second current path of the plurality of pins.

7. The antenna system according to claim 2, wherein distance between two consecutive radiating waveguide antenna cells of the plurality of radiating waveguide antenna cells is one of a half wavelength of the first frequency range or a value between the first frequency range and the second frequency range.

8. The antenna system according to claim 1, wherein the waveguide antenna element based beam forming phased array further comprises a plurality of non-radiating dummy waveguide antenna cells in a first layout, wherein the plurality of non-radiating dummy waveguide antenna cells are at edge regions of the plurality of radiating waveguide antenna cells to enable even radiation for the millimeter wave communication through a second end of each of the plurality of radiating waveguide antenna cells.

9. The antenna system according to claim 8, further comprising a second substrate, wherein the plurality of non-radiating dummy waveguide antenna cells are mounted on the second substrate that is different than the first substrate.

10. The antenna system according to claim 8, wherein the first substrate comprises an upper side and a lower side, wherein the first end of the plurality of radiating waveguide antenna cells of the waveguide antenna element based beam forming phased array is mounted on the upper side of the first substrate, and the plurality of chips are between the lower side of the first substrate and an upper surface of a system board.

11. The antenna system according to claim 1, wherein the first substrate comprises an upper side and a lower side, wherein the plurality of chips and the plurality of radiating waveguide antenna cells of the waveguide antenna element based beam forming phased array are on the upper side of the first substrate.

12. The antenna system according to claim 11, wherein a vertical length between the plurality of chips and the first end of the plurality of radiating waveguide antenna cells of the waveguide antenna element based beam forming phased array is less than a threshold value to reduce insertion loss between the plurality of radiating waveguide antenna cells and the plurality of chips.

13. The antenna system according to claim 11, wherein the waveguide antenna element based beam forming phased array has a metallic electrically conductive surface that acts as a heat sink to dissipate heat from the plurality of chips to atmospheric air through the metallic electrically conductive surface of the waveguide antenna element based beam forming phased array, and wherein the heat is dissipated based on a contact of the plurality of chips with the plurality of radiating waveguide antenna cells of the waveguide antenna element based beam forming phased array on the upper side of the first substrate.

14. The antenna system according to claim 1, the waveguide antenna element based beam forming phased array is a dual-polarized open waveguide array antenna configured to transmit and receive radio frequency waves for the millimeter wave communication in both horizontal and vertical polarizations or as left hand circular polarization (LHCP) or right hand circular polarization (RHCP).

15. The antenna system according to claim 1, wherein the plurality of pins in each radiating waveguide antenna cell includes a pair of vertical polarization pins and a pair of horizontal polarization pins, wherein the pair of vertical polarization pins comprises a first positive terminal and a first negative terminal and the pair of horizontal polarization pins comprises a second positive terminal and a second negative terminal, and wherein the pair of vertical polarization pins and the pair of horizontal polarization pins are utilized for dual-polarization.

16. The antenna system according to claim 1, wherein the plurality of chips comprises a set of receiver (Rx) chips, a set of transmitter (Tx) chips, and a signal mixer chip.

17. The antenna system according to claim 1, wherein the plurality of chips are configured to control propagation and a direction of a radio frequency (RF) beam in millimeter wave frequency through a second end of the plurality of radiating waveguide antenna cells for the millimeter wave communication between the antenna system and a millimeter wave-based communication device, and wherein the second end is an open end of the plurality of radiating waveguide antenna cells for the millimeter wave communication.

18. The antenna system according to claim 17, wherein the propagation of the radio frequency (RF) beam in millimeter wave frequency is controlled based on at least a flow of a first RF current and a second RF current in each radiating waveguide antenna cell, wherein the first RF current and the second RF current flows from the ground towards a negative terminal of the first chip of the plurality of chips via at least a first pin of the plurality of pins, and from a positive terminal of the first chip towards the ground via at least a second pin of the plurality of pins in each corresponding radiating waveguide antenna cell of the plurality of radiating waveguide antenna cells.

19. The antenna system according to claim 1, further comprising an interposer beneath an edge regions of the waveguide antenna element based beam forming phased array at the first end in a first layout to shield radiation leakage from the first end of the plurality of radiating waveguide antenna cells of the waveguide antenna element based beam forming phased array.

20. The antenna system according to claim 1, further comprising a ground (gnd) layer between the first end of the plurality of radiating waveguide antenna cells of the waveguide antenna element based beam forming phased array and the first substrate.

* * * * *